US011466352B2

(12) United States Patent
Das et al.

(10) Patent No.: US 11,466,352 B2
(45) Date of Patent: Oct. 11, 2022

(54) FORMABLE, HIGH STRENGTH ALUMINUM ALLOY PRODUCTS AND METHODS OF MAKING THE SAME

(71) Applicant: Novelis Inc., Atlanta, GA (US)

(72) Inventors: Sazol Kumar Das, Acworth, GA (US); Rajeev G. Kamat, Marietta, GA (US); Rajasekhar Talla, Woodstock, GA (US); Tudor Piroteala, Acworth, GA (US)

(73) Assignee: Novelis Inc., Atlanta, GA (US)

( * ) Notice: Subject to any disclaimer, the term of this patent is extended or adjusted under 35 U.S.C. 154(b) by 230 days.

(21) Appl. No.: 16/661,290

(22) Filed: Oct. 23, 2019

(65) Prior Publication Data

US 2020/0123641 A1 Apr. 23, 2020

Related U.S. Application Data

(60) Provisional application No. 62/749,158, filed on Oct. 23, 2018.

(51) Int. Cl.

| | |
|---|---|
| ***C22F 1/053*** | (2006.01) |
| ***B21B 3/00*** | (2006.01) |
| ***B22D 11/00*** | (2006.01) |
| ***C22C 21/10*** | (2006.01) |

(52) U.S. Cl.

CPC ..... *C22F 1/053* (2013.01); *B21B 3/00* (2013.01); *B22D 11/003* (2013.01); *C22C 21/10* (2013.01); *B21B 2003/001* (2013.01)

(58) Field of Classification Search

CPC . C22F 1/053; C22F 21/10; B21B 3/00; B21B 2003/001; C22C 21/10; B22D 11/003

USPC ..... 148/695

See application file for complete search history.

(56) References Cited

U.S. PATENT DOCUMENTS

| | | | | |
|---|---|---|---|---|
| 2003/0150587 | A1 | 8/2003 | Li et al. | |
| 2004/0011438 | A1 | 1/2004 | Lorentzen et al. | |
| 2015/0376742 | A1* | 12/2015 | Matsumoto | C22C 21/08 420/532 |
| 2018/0119261 | A1 | 5/2018 | Das et al. | |

(Continued)

FOREIGN PATENT DOCUMENTS

| | | |
|---|---|---|
| CN | 107109547 | 8/2017 |
| JP | 07252573 | 10/1995 |

(Continued)

OTHER PUBLICATIONS

"Wrought Aluminum Processes and Products", ASM Handbook, vol. 2A, Aluminum Science and Technology (Year: 2018).*

(Continued)

*Primary Examiner* — Brian D Walck
*Assistant Examiner* — D. M. C.
(74) *Attorney, Agent, or Firm* — Kilpatsick Townsend & Stockton LLP

(57) ABSTRACT

Described herein are formable, high strength aluminum alloy products and methods of preparing and processing the same. The methods of preparing and processing the aluminum alloy products include casting an aluminum alloy and performing tailored rolling and downstream thermal processing steps. The resulting aluminum alloy products possess high strength and formability properties.

15 Claims, 20 Drawing Sheets

(56) References Cited

U.S. PATENT DOCUMENTS

| | | | |
|---|---|---|---|
| 2018/0119262 | A1 | 5/2018 | Felberbaum et al. |
| 2018/0202031 | A1 | 7/2018 | Wu et al. |

FOREIGN PATENT DOCUMENTS

| | | |
|---|---|---|
| JP | 2015071823 | 4/2015 |
| TW | 200925292 | 6/2009 |

OTHER PUBLICATIONS

Karhausen K.F., Seiferth O. (2014) Aluminium Hot and Cold Rolling. In: Mang T. (eds) Encyclopedia of Lubricants and Lubrication. Springer, Berlin, Heidelberg (Year: 2014).*

PCT/US2019/057581 , "International Search Report and Written Opinion", dated Feb. 24, 2020, 11 pages.

Chinese Application No. 201980069839.1 , Office Action, dated Nov. 23, 2021, 22 pages.

Yi et al., "Development of High Strength Aluminum Alloys", Popular Science and Technology, vol. 12, Dec. 10, 2008, pp. 143-144.

Canadian Application No. 3,110,115 , Office Action, dated Jan. 31, 2022, 3 pages.

Indian Application No. 202117017020 , "First Examination Report", dated Jan. 27, 2022, 6 pages.

Chinese Application No. 201980069839.1 , Office Action, dated Apr. 22, 2022, 11 pages.

Japanese Application No. 2021-547066 , Office Action, dated May 10, 2022, 15 pages.

Chinese Application No. 201980069839.1 , "Office Action", dated Jul. 15, 2022, 14 pages.

European Application No. 19802423.4 , "Office Action", dated Jul. 13, 2022, 5 pages.

Korean Application No. 10-2021-7007654 , "Office Action", dated Jun. 29, 2022, 5 pages.

Ren et al., "Principles and Techniques of Metallographic Analysis", Shanghai Scientific and Technology Literature Press, Aug. 2013, 7 pages.

* cited by examiner

FORMABLE, HIGH STRENGTH ALUMINUM ALLOY PRODUCTS AND METHODS OF MAKING THE SAME

CROSS-REFERENCE TO RELATED APPLICATION

The present application claims priority to and filing benefit of U.S. Patent Application No. 62/749,158, filed on Oct. 23, 2018, which is incorporated herein by reference in its entirety.

FIELD

The present disclosure relates to the field of aluminum alloys and more specifically to methods of producing and processing aluminum alloy products.

BACKGROUND

Aluminum alloys with high strength are desirable for improved product performance in many applications, such as automotive and other transportation applications (including, for example and without limitation, trucks, trailers, trains, aerospace applications, and marine applications), and electronics applications, among others. In some cases, such alloys should exhibit, among other properties, high strength and high formability (e.g., an ability to be formed into a desired shape). Achieving aluminum alloy products having high strength often results in a loss of formability. Conversely, providing highly formable aluminum alloy products often results in a lower strength product.

SUMMARY

Covered embodiments of the invention are defined by the claims, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification, any or all drawings, and each claim.

Described herein are methods of producing a formable, high strength aluminum alloy product, comprising continuously casting a molten aluminum alloy composition to provide a cast aluminum alloy product having a casting exit temperature, wherein the molten aluminum alloy composition comprises an aluminum alloy comprising at least 0.1 wt. % Zr, at least 2 wt. % Mg, and Zn as a predominate alloying element other than Al; cooling the cast aluminum alloy product to a temperature of from 20° C. to 50° C. below the casting exit temperature to provide a thermally stabilized cast aluminum alloy product; hot rolling the thermally stabilized cast aluminum alloy product to provide an aluminum alloy hot band; coiling the aluminum alloy hot band to provide a hot band coil; cooling the hot band coil to a temperature of from 200° C. to 400° C.; further processing the hot band coil to provide a final gauge aluminum alloy product; and solutionizing the final gauge aluminum alloy product. In some examples, the molten aluminum alloy composition comprises a Zn to Mg ratio of from 1.2 to 3. In certain cases, the methods further comprise hot rolling the cast aluminum alloy product wherein the hot rolling comprises heating the thermally stabilized cast aluminum alloy product to a hot rolling entry temperature. In some cases, hot rolling the thermally stabilized cast aluminum alloy product is performed to reduce a thickness of the thermally stabilized cast aluminum alloy product by at least 30% (e.g., by 40% to 50%).

In some cases, the further processing step can comprise homogenizing the hot band coil to provide a homogenized hot band coil and hot rolling the homogenized hot band coil to provide the final gauge aluminum alloy product. In other cases, the further processing step can comprise homogenizing the hot band coil to provide a homogenized hot band coil, cooling the homogenized hot band coil, and cold rolling the homogenized hot band coil to provide a final gauge aluminum alloy product. In still other cases, the further processing step can comprise cold rolling the hot band coil to provide a final gauge aluminum alloy product. The homogenizing step can comprise heating the aluminum alloy hot band to a homogenizing temperature of at least about 450° C. and maintaining the aluminum alloy hot band at the homogenizing temperature of at least about 450° C. for a time period of at least about 90 minutes (e.g., from about 90 minutes to about 150 minutes).

The method can further comprise a step of pre-aging the final gauge aluminum alloy product. The pre-aging can comprise heating the final gauge aluminum alloy product to a pre-aging temperature of from about 50° C. to about 150° C. and maintaining the pre-aging temperature for a period of from about 1 hour to about 24 hours. The method can further comprise a step of aging the final gauge aluminum alloy product to achieve a yield strength of at least about 400 MPa. The aging can comprise one or more of natural aging, artificial aging, paint baking, and post-forming heat treating. In some cases, the natural aging comprises maintaining the final gauge aluminum alloy product at room temperature for a period of from about 1 day to about 12 weeks. The artificial aging can comprise heating the final gauge aluminum alloy product to an artificial aging temperature of from about 100° C. to about 250° C. and maintaining the artificial aging temperature for a period of from about 1 hour to about 72 hours (e.g., from about 12 hours to about 72 hours). The paint baking can comprise heating the final gauge aluminum alloy product to a paint baking temperature of from about 75° C. to about 250° C. and maintaining the paint baking temperature for a period of from about 15 minutes to about 3 hours. The post-forming heat treating can comprise heating the final gauge aluminum alloy product to a post-forming heat treating temperature of from about 100° C. to about 250° C. and maintaining the post-forming heat treating temperature for a period of from about 1 hour to about 24 hours.

Also described herein are aluminum alloy products prepared according to the methods as described herein. The aluminum alloy products can achieve an increase in both elongation and yield strength after aging, as compared to the aluminum alloy products before any aging (e.g., before natural aging, artificial aging, paint baking, or post-forming heat treating). The increase in elongation can be at least about 1% (e.g., about 1.5% to about 5%). The increase in yield strength can be at least about 15 MPa (e.g., from about 15 MPa to about 25 MPa).

Other objects and advantages of the invention will be apparent from the following detailed description of non-limiting examples of the invention and figures.

DETAILED DESCRIPTION

Figure 1A:
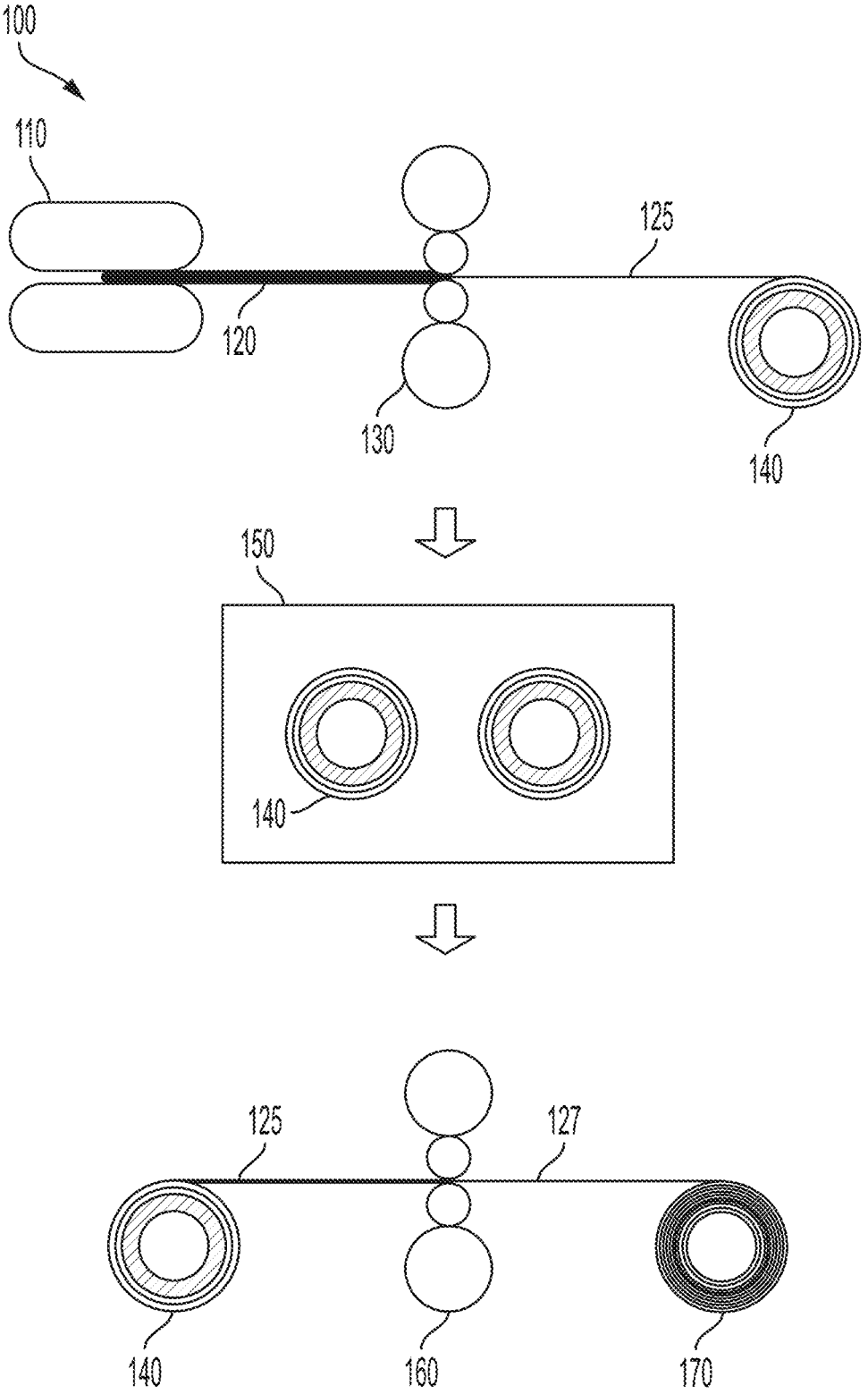
FIG. 1A is a schematic diagram depicting an aluminum alloy processing method described herein.

Described herein are methods of processing high strength aluminum alloy products using a continuous casting step, a tailored hot rolling schedule, and various downstream processing steps, along with aluminum alloy products prepared and processed according to the methods. The methods of processing the aluminum alloy products described herein provide a more efficient method for producing aluminum alloy products having high strength and formability properties, as required by end users (e.g., original equipment manufacturers (OEMs)). Typically, high strength aluminum alloy products can suffer from low formability due to hardening that occurs during aging practices. Likewise, highly formable aluminum alloy products can lack the strength required for use as structural members in automotive, transportation, electronics, specialty applications, or any combination thereof. The aluminum alloy products described herein, however, exhibit high strength properties without any loss in formability, and, in some cases, with improved formability. The aluminum alloy products described herein are also amenable to room temperature forming, and can achieve complex shapes as desired, for example, in the automotive industry and other industries.

Definitions and Descriptions

The terms "invention," "the invention," "this invention," and "the present invention" used herein are intended to refer broadly to all of the subject matter of this patent application and the claims below. Statements containing these terms should be understood not to limit the subject matter described herein or to limit the meaning or scope of the patent claims below.

In this description, reference is made to alloys identified by aluminum industry designations, such as "series" or "7xxx." For an understanding of the number designation system most commonly used in naming and identifying aluminum and its alloys, see "International Alloy Designations and Chemical Composition Limits for Wrought Aluminum and Wrought Aluminum Alloys" or "Registration Record of Aluminum Association Alloy Designations and Chemical Compositions Limits for Aluminum Alloys in the Form of Castings and Ingot," both published by The Aluminum Association.

The following aluminum alloys are described in terms of their elemental composition in weight percentage (wt. %, or %) based on the total weight of the alloy. In certain examples of each alloy, the remainder is aluminum, with a maximum wt. % of 0.15% for the sum of the impurities.

As used herein, the meaning of "a," "an," or "the" includes singular and plural references unless the context clearly dictates otherwise.

As used herein, a plate generally has a thickness of greater than about 15 mm up to about 200 mm. For example, a plate may refer to an aluminum alloy product having a thickness of greater than about 15 mm, greater than about 20 mm, greater than about 25 mm, greater than about 30 mm, greater than about 35 mm, greater than about 40 mm, greater than about 45 mm, greater than about 50 mm, greater than about 100 mm, or up to about 200 mm.

As used herein, a shate (also referred to as a sheet plate) generally has a thickness of from about 4 mm to about 15 mm. For example, a shate may have a thickness of about 4 mm, about 5 mm, about 6 mm, about 7 mm, about 8 mm, about 9 mm, about 10 mm, about 11 mm, about 12 mm, about 13 mm, about 14 mm, or about 15 mm.

As used herein, a sheet generally refers to an aluminum alloy product having a thickness of less than about 4 mm. For example, a sheet may have a thickness of less than about 4 mm, less than about 3 mm, less than about 2 mm, less than about 1 mm, less than about 0.5 mm, less than about 0.3 mm, or less than about 0.1 mm.

Reference is made in this application to alloy condition or temper. For an understanding of the alloy temper descriptions most commonly used, see "American National Standards (ANSI) H35 on Alloy and Temper Designation Systems." An F condition or temper refers to an aluminum alloy as fabricated. An O condition or temper refers to an aluminum alloy after annealing. A T1 condition or temper refers to an aluminum alloy cooled from hot working and naturally aged (e.g., at room temperature). A T2 condition or temper refers to an aluminum alloy cooled from hot working, cold worked, and naturally aged. A T3 condition or temper refers to an aluminum alloy solution heat treated, cold worked, and naturally aged. A T4 condition or temper refers to an aluminum alloy solution heat treated and naturally aged. A T5 condition or temper refers to an aluminum alloy cooled from hot working and artificially aged (at elevated temperatures). A T6 condition or temper refers to an aluminum alloy solution heat treated and artificially aged. A T7 condition or temper refers to an aluminum alloy solution heat treated and artificially overaged. A T8x condition or temper refers to an aluminum alloy solution heat treated, cold worked, and artificially aged. A T9 condition or temper refers to an aluminum alloy solution heat treated, artificially aged, and cold worked.

As used herein, terms such as "cast metal product," "cast product," "cast aluminum alloy product," and the like are interchangeable and refer to a product produced by direct chill casting (including direct chill co-casting) or semi-continuous casting, continuous casting (including, for example, by use of a twin belt caster, a twin roll caster, a block caster, or any other continuous caster), electromagnetic casting, hot top casting, or any other casting method.

As used herein, the meaning of "room temperature" can include a temperature of from about 15° C. to about 30° C., for example about 15° C., about 16° C., about 17° C., about 18° C., about 19° C., about 20° C., about 21° C., about 22° C., about 23° C., about 24° C., about 25° C., about 26° C., about 27° C., about 28° C., about 29° C., or about 30° C.

All ranges disclosed herein are to be understood to encompass any endpoints, and any and all subranges subsumed therein. For example, a stated range of "1 to 10" should be considered to include any and all subranges between (and inclusive of) the minimum value of 1 and the maximum value of 10; that is, all subranges beginning with a minimum value of 1 or more, e.g. 1 to 6.1, and ending with a maximum value of 10 or less, e.g., 5.5 to 10.

Preparing and Processing Methods

The methods of producing a formable, high strength aluminum alloy product described herein include casting a molten aluminum alloy composition (e.g., by continuous casting), hot rolling the cast aluminum alloy product to provide an aluminum alloy hot band, coiling and cooling the aluminum alloy hot band to provide a hot band coil, followed by one or more further processing steps to provide a final gauge aluminum alloy product.

In some cases, the processing methods can include hot rolling, homogenizing, hot rolling to a final gauge, and solutionizing. In other cases, the processing methods can include hot rolling, homogenizing, coil cooling, cold rolling to a final gauge, and solutionizing. In still other cases, the processing methods can include hot rolling, coil cooling, cold rolling to a final gauge, and solutionizing. Any of the above described processing methods can be combined with downstream processing methods, including forming and further heat treating, to provide high strength and formable aluminum alloy products.

The aluminum alloy products described herein can be prepared from an aluminum alloy composition including at least about 0.1 wt. % zirconium (Zr), at least about 2 wt. % magnesium (Mg), and zinc (Zn) as a predominate alloying element (e.g., at least about 3 wt. %) other than aluminum (Al). The presence of Zr in an amount of at least about 0.10 wt. %, Mg in an amount of at least about 2 wt. %, and Zn as the predominate alloying element (other than Al), in combination with the processing conditions described below, results in an aluminum alloy product having exceptional strength and formability. In some cases, the combination results in an aluminum alloy product having high corrosion resistance.

In some cases, Zr is present in an amount of from about 0.1% to about 2% (e.g., from about 0.15% to about 1.5%, from about 0.2% to about 1.3%, or from about 0.5% to about 1%) based on the total weight of the aluminum alloy. For example, the aluminum alloy can include Zr in an amount of about 0.1%, about 0.2%, about 0.3%, about 0.4%, about 0.5%, about 0.6%, about 0.7%, about 0.8%, about 0.9%, about 1%, about 1.1%, about 1.2%, about 1.3%, about 1.4%, about 1.5%, about 1.6%, about 1.7%, about 1.8%, about 1.9%, or about 2%.

In some cases, Mg can be present in an amount of at least about 2% (e.g., from about 2% to about 5%, from about 2.1% to about 4.9%, from about 2.2% to about 4.8%, from about 2.3% to about 4.75%, from about 2.4% to about 4.7%, from about 2.5% to about 4.6%, from about 2.75% to about 4.5%, or from about 3% to about 4.25%). For example, the aluminum alloy can include Mg in an amount of about 2%, about 2.1%, about 2.2%, about 2.3%, about 2.4%, about 2.5%, about 2.6%, about 2.7%, about 2.8%, about 2.9%, about 3%, about 3.1%, about 3.2%, about 3.3%, about 3.4%, about 3.5%, about 3.6%, about 3.7%, about 3.8%, about 3.9%, about 4%, about 4.1%, about 4.2%, about 4.3%, about 4.4%, about 4.5%, about 4.6%, about 4.7%, about 4.8%, about 4.9%, or about 5%.

As noted above, Zn can be the predominate alloying element, other than Al, in the aluminum alloy. In some cases, Zn is present in an amount of at least about 3% (e.g., from about 3% to about 20%, from about 4.5% to about 18%, from about 7.5% to about 15%, from about 10% to about 15%, from about 3.5% to about 10.5%, or from about 4% to about 8%). For example, the aluminum alloy can include Zn in an amount of about 3%, about 3.1%, about 3.2%, about 3.3%, about 3.4%, about 3.5%, about 3.6%, about 3.7%, about 3.8%, about 3.9%, about 4%, about 4.1%, about 4.2%, about 4.3%, about 4.4%, about 4.5%, about 4.6%, about 4.7%, about 4.8%, about 4.9%, about 5%, about 5.1%, about 5.2%, about 5.3%, about 5.4%, about 5.5%, about 5.6%, about 5.7%, about 5.8%, about 5.9%, about 6%, about 6.1%, about 6.2%, about 6.3%, about 6.4%, about 6.5%, about 6.6%, about 6.7%, about 6.8%, about 6.9%, about 7%, about 7.1%, about 7.2%, about 7.3%, about 7.4%, about 7.5%, about 7.6%, about 7.7%, about 7.8%, about 7.9%, about 8%, about 8.1%, about 8.2%, about 8.3%, about 8.4%, about 8.5%, about 8.6%, about 8.7%, about 8.8%, about 8.9%, about 9%, about 9.1%, about 9.2%, about 9.3%, about 9.4%, about 9.5%, about 9.6%, about 9.7%, about 9.8%, about 9.9%, about 10%, about 10.1%, about 10.2%, about 10.3%, about 10.4%, about 10.5%, about 10.6%, about 10.7%, about 10.8%, about 10.9%, about 11%, about 11.1%, about 11.2%, about 11.3%, about 11.4%, about 11.5%, about 11.6%, about 11.7%, about 11.8%, about 11.9%, about 12%, about 12.1%, about 12.2%, about 12.3%, about 12.4%, about 12.5%, about 12.6%, about 12.7%, about 12.8%, about 12.9%, about 13%, about 13.1%, about 13.2%, about 13.3%, about 13.4%, about 13.5%, about 13.6%, about 13.7%, about 13.8%, about 13.9%, about 14%, about 14.1%, about 14.2%, about 14.3%, about 14.4%, about 14.5%, about 14.6%, about 14.7%, about 14.8%, about 14.9%, about 15%, about 15.1%, about 15.2%, about 15.3%, about 15.4%, about 15.5%, about 15.6%, about 15.7%, about 15.8%, about 15.9%, about 16%, about 16.1%, about 16.2%, about 16.3%, about 16.4%, about 16.5%, about 16.6%, about 16.7%, about 16.8%, about 16.9%, about 17%, about 17.1%, about 17.2%, about 17.3%, about 17.4%, about 17.5%, about 17.6%, about 17.7%, about 17.8%, about 17.9%, about 18%, about 18.1%, about 18.2%, about 18.3%, about 18.4%, about 18.5%, about 18.6%, about 18.7%, about 18.8%, about 18.9%, about 19%, about 19.1%, about 19.2%, about 19.3%, about 19.4%, about 19.5%, about 19.6%, about 19.7%, about 19.8%, about 19.9%, or about 20%.

In some cases, the amounts of Zn and Mg are controlled relative to each other. For example, in cases where the amount of Mg is about 3.5% or greater, the amount of Zn included in the composition can be lower than 7% (e.g., lower than 6.9%, lower than 6.8%, lower than 6.7%, lower than 6.6%, lower than 6.5%, lower than 6.4%, lower than 6.3%, lower than 6.2%, lower than 6.1%, lower than 6%, lower than 5.9%, lower than 5.8%, lower than 5.7%, lower than 5.6%, lower than 5.5%, lower than 5.4%, lower than 5.3%, lower than 5.2%, lower than 5.1%, lower than 5%, lower than 4.9%, lower than 4.8%, lower than 4.7%, lower than 4.6%, or lower than 4.5%). Controlling the Zn and Mg amounts in this manner is a factor in achieving the high strength and formability exhibited by the aluminum alloy products described herein. Not to be bound by theory, Mg can increase both strength and formability when used as an alloying element in aluminum. Incorporating Zn and Mg in a Zn to Mg ratio (i.e., weight percentage of Zn/weight percentage of Mg) of from about 1.2 to about 3 can further increase strength and provide excellent formability. In some cases, Zn and Mg can be incorporated in amounts to provide a Zn to Mg ratio of from about 1.2 to about 2.7, from about 1.3 to about 2.5, from about 1.4 to about 2.2, from about 1.5 to about 2, or from about 1.2 to about 1.7. For example, the Zn to Mg ratio can be about 1.2, about 1.3, about 1.4, about 1.5, about 1.6, about 1.7, about 1.8, about 1.9, about 2, about 2.1, about 2.2, about 2.3, about 2.4, about 2.5, about 2.6, about 2.7, about 2.8, about 2.9, about 3, or anywhere in between.

In some non-limiting examples, the Zn and Mg, in combination, can increase corrosion resistance exhibited by the aluminum alloy products. In some examples, the combined amount of Zn and Mg present in the composition is from about 5.8% to about 25% (e.g., from about 6% to about 20%, from about 6.5% to about 18%, or from about 7% to about 15%). For example, the combined amount of Zn and Mg can be about 6%, about 6.5%, about 7%, about 7.5%, about 8%, about 8.5%, about 9%, about 9.5%, about 10%, about 10.5%, about 11%, about 11.5%, about 12%, about 12.5%, about 13%, about 13.5%, about 14%, about 14.5%, about 15%, about 15.5%, about 16%, about 16.5%, about 17%, about 17.5%, about 18%, about 18.5%, about 19%, about 19.5%, about 20%, about 20.5%, about 21%, about 21.5%, about 22%, about 22.5%, about 23%, about 23.5%, about 24%, about 24.5%, or about 25%.

Optionally, an aluminum alloy for use in preparing the aluminum alloy products described herein can additionally include one or more of copper (Cu), iron (Fe), manganese (Mn), silicon (Si), titanium (Ti), and chromium (Cr), and one or more impurities, with Al as the remainder. In some examples, the aluminum alloy includes Cu in an amount of from about 0.1% to about 3% (e.g., from about 0.1% to about 2.6% or from about 0.15% to about 2%) based on the total weight of the alloy. For example, the alloy can include about 0.1%, about 0.2%, about 0.3%, about 0.4%, about 0.5%, about 0.6%, about 0.7%, about 0.8%, about 0.9%, about 1%, about 1.1%, about 1.2%, about 1.3%, about 1.4%, about 1.5%, about 1.6%, about 1.7%, about 1.8%, about 1.9%, about 2%, about 2.1%, about 2.2%, about 2.3%, about 2.4%, about 2.5%, about 2.6%, about 2.7%, about 2.8%, about 2.9%, or about 3% Cu. In some cases, Cu is not present in the alloy (i.e., 0%).

In some examples, the aluminum alloy includes Fe in an amount of up to about 0.25% (e.g., from 0% to about 0.15% or from about 0.05% to about 0.10%) based on the total weight of the alloy. For example, the alloy can include about 0.01%, about 0.02%, about 0.03%, about 0.04%, about 0.05%, about 0.06%, about 0.07%, about 0.08%, about 0.09%, about 0.1%, about 0.11%, about 0.12%, about 0.13%, about 0.14%, about 0.15%, about 0.16%, about 0.17%, about 0.18%, about 0.19%, about 0.2%, about 0.21%, about 0.22%, about 0.23%, about 0.24%, or about 0.25% Fe. In some cases, Fe is not present in the alloy (i.e., 0%).

In some examples, the aluminum alloy includes Mn, Si, Ti, and/or Cr, each in an amount of up to about 0.2% (e.g., from 0% to about 0.1% or from about 0.05% to about 0.15%) based on the total weight of the alloy. For example, the alloy can include about 0.01%, about 0.02%, about 0.03%, about 0.04%, about 0.05%, about 0.06%, about 0.07%, about 0.08%, about 0.09%, about 0.1%, about 0.11%, about 0.12%, about 0.13%, about 0.14%, about 0.15%, about 0.16%, about 0.17%, about 0.18%, about 0.19%, or about 0.2% each of Mn, Si, Ti, and/or Cr. In some cases, one or more of Mn, Si, Ti, or Cr is not present in the alloy (i.e., 0%).

Optionally, the aluminum alloy can further include other minor elements, sometimes referred to as impurities, in amounts of about 0.05% or below, about 0.04% or below, about 0.03% or below, about 0.02% or below, or about 0.01% or below each. These impurities may include, but are not limited to, V, Ni, Sn, Ga, Ca, Bi, Na, Pb, or combinations thereof. Accordingly, V, Ni, Sn, Ga, Ca, Bi, Na, or Pb may be present in alloys in amounts of about 0.05% or below, about 0.04% or below, about 0.03% or below, about 0.02% or below, or about 0.01% or below. The sum of all impurities does not exceed about 0.15% (e.g., about 0.10%). The remaining percentage of the alloy is aluminum.

Optionally, suitable aluminum alloy products for use in the methods described herein include 7xxx series aluminum alloys. In some cases, a 7xxx series aluminum alloy for use in the methods described herein can be a 7xxx series aluminum alloy as registered with the Aluminum Association, and can optionally be modified to include an amount of Zr, Mg, Zn, and/or any other element as described above. The 7xxx series aluminum alloy can include, for example, AA7003, AA7004, AA7204, AA7005, AA7108, AA7108A, AA7009, AA7010, AA7012, AA7014, AA7015, AA7016, AA7116, AA7017, AA7018, AA7019, AA7019A, AA7020, AA7021, AA7022, AA7122, AA7023, AA7024, AA7025, AA7026, AA7028, AA7029, AA7129, AA7229, AA7030, AA7031, AA7032, AA7033, AA7034, AA7035, AA7035A, AA7036, AA7136, AA7037, AA7039, AA7040, AA7140, AA7041, AA7042, AA7046, AA7046A, AA7047, AA7049, AA7049A, AA7149, AA7249, AA7349, AA7449, AA7050, AA7050A, AA7150, AA7055, AA7155, AA7255, AA7056, AA7060, AA7064, AA7065, AA7068, AA7168, AA7072, AA7075, AA7175, AA7475, AA7076, AA7178, AA7278, AA7278A, AA7081, AA7181, AA7085, AA7185, AA7090, AA7093, AA7095, AA7099, or AA7199 that has optionally been modified to include at least about 0.1 wt. % Zr, at least about 2.8 wt. % magnesium (Mg), and zinc (Zn) as a predominate alloying element.

In some examples, the alloy is a monolithic alloy. In some examples, the alloy is a clad aluminum alloy, having a core layer and one or two cladding layers. In some cases, the core layer may be different from one or both of the cladding layers. The core layer can be, for example, an aluminum alloy as described herein (e.g., an aluminum alloy including at least about 0.1 wt. % Zr, at least about 2 wt. % Mg, and Zn as a predominate alloying element other than Al).

Casting

The alloys can be cast using any suitable casting process. For example, a molten aluminum alloy composition including an aluminum alloy as described herein may be cast using a continuous casting (CC) process that may include, but is not limited to, the use of twin belt casters, twin roll casters, or block casters. In some examples, the casting process is performed by a CC process to form a cast product such as a billet, slab, strip, or the like.

In some cases, the resulting cast aluminum alloy product can exit the caster at a temperature (e.g., a caster exit temperature) of from about 370° C. to about 450° C. For example, the cast aluminum alloy product can have a caster exit temperature of about 370° C., about 380° C., about 390° C., about 400° C., about 410° C., about 420° C., about 430° C., about 440° C., about 450° C., or anywhere in between.

The resulting cast aluminum alloy product can have a thickness of about 5 mm to about 50 mm (e.g., from about 10 mm to about 45 mm, from about 15 mm to about 40 mm, or from about 20 mm to about 35 mm), such as about 10 mm. For example, the cast aluminum alloy product can be about 5 mm, about 6 mm, about 7 mm, about 8 mm, about 9 mm, about 10 mm, about 11 mm, about 12 mm, about 13 mm, about 14 mm, about 15 mm, about 16 mm, about 17 mm, about 18 mm, about 19 mm, about 20 mm, about 21 mm, about 22 mm, about 23 mm, about 24 mm, about 25 mm, about 26 mm, about 27 mm, about 28 mm, about 29 mm, about 30 mm, about 31 mm, about 32 mm, about 33 mm, about 34 mm, about 35 mm, about 36 mm, about 37 mm, about 38 mm, about 39 mm, about 40 mm, about 41 mm, about 42 mm, about 43 mm, about 44 mm, about 45 mm, about 46 mm, about 47 mm, about 48 mm, about 49 mm, or about 50 mm thick.

The cast aluminum alloy product can then be subjected to further processing steps. In some non-limiting examples, the processing method includes hot rolling, coiling, coil cooling, further processing steps described below, solutionizing, and/or aging. In some cases, the further processing can include homogenizing and hot rolling to a final gauge. In other cases, the further processing steps can include homogenizing, cooling, and cold rolling to a final gauge. In still other cases, the further processing steps can include cold rolling to a final gauge.

Optional Processing After Casting

In certain examples, following the casting step the cast aluminum alloy product can be subjected to optional cooling, homogenizing, and/or reheating. In some cases, the cooling is performed to reduce the temperature of the cast aluminum alloy product from about 20° C. to about 50° C. below a caster exit temperature. In some cases, the caster exit temperature can be from about 400° C. to about 430° C. (e.g., the caster exit temperature can be about 400° C., 410° C., 420° C., or 430° C.). In some cases the cooling step provides a thermally stable cast aluminum alloy product. Cooling can be performed by roll cooling, coil cooling, forced air cooling, water cooling, water mist cooling, emulsion cooling, any suitable cooling technique, or any combination thereof.

In other examples, the homogenizing step is performed after casting in an in-line process or after cooling in an in-line process. In an optional in-line process, the cast aluminum alloy product or the thermally stable cast aluminum alloy product is passed through a tunnel furnace to homogenize the cast aluminum alloy product or the thermally stable cast aluminum alloy product at a homogenizing temperature (i.e., a peak metal temperature (PMT)) of from about 400° C. to about 520° C. (e.g., from about 410° C. to about 510° C., from about 420° C. to about 500° C., from about 420° C. to about 520° C., from about 400° C. to about 500° C., or from about 425° C. to about 475° C.). For example, the homogenizing temperature can be about 400° C., about 410° C., about 420° C., about 430° C., about 440° C., about 450° C., about 460° C., about 470° C., about 480° C., about 490° C., about 500° C., about 510° C., or about 520° C. In some cases, the homogenizing step is used to maintain a uniform temperature of the cast aluminum alloy product or the thermally stable cast aluminum alloy product. For example, an as-cast aluminum alloy product may cool non-uniformly where cooling can occur faster at an edge of the cast aluminum alloy product than at a center of a cast aluminum alloy product. Passing the cast aluminum alloy product or the thermally stable cast aluminum alloy product through a tunnel furnace after casting or after cooling to provide a thermally stabilized cast aluminum alloy product can provide a uniformly cooled cast aluminum alloy product.

In some examples, the reheating step is performed to prepare the cast aluminum alloy product or the thermally stable cast aluminum alloy product for a subsequent hot rolling step. The reheating step can be performed as an in-line process (e.g., in a tunnel furnace) or as an off-line process (e.g., a coiled cast aluminum alloy product or a coiled thermally stable cast aluminum alloy product can be reheated in a box furnace before hot rolling). In some cases, reheating is performed by heating the cast aluminum alloy product or the thermally stable cast aluminum alloy product to a hot rolling temperature described below.

Hot Rolling

Following the casting step, a hot rolling step can be performed. In some cases, the hot rolling step can be performed immediately after the casting. The hot rolling step can include a hot reversing mill operation and/or a hot tandem mill operation. The hot rolling step can be performed at a hot rolling temperature (e.g., a hot rolling entry temperature) ranging from about 250° C. to about 500° C. (e.g., from about 300° C. to about 400° C. or from about 350° C. to about 430° C.). For example, the hot rolling step can be performed at a hot rolling temperature of about 250° C., about 260° C., about 270° C., about 280° C., about 290° C., about 300° C., about 310° C., about 320° C., about 330° C., about 340° C., about 350° C., about 360° C., about 370° C., about 380° C., about 390° C., about 400° C., about 410° C., about 420° C., about 430° C., about 440° C., about 450° C., about 460° C., about 470° C., about 480° C., about 490° C., about 500° C., or anywhere in between.

In the hot rolling step, the cast aluminum alloy product can be hot rolled to a thickness of 15 mm or less (e.g., from about 2 mm to about 10 mm), providing an aluminum alloy hot band. For example, the cast aluminum alloy product can be hot rolled to about a 15 mm gauge or less, a 14 mm gauge or less, a 13 mm gauge or less, a 12 mm gauge or less, an 11 mm gauge or less, a 10 mm gauge or less, a 9 mm gauge or less, an 8 mm gauge or less, a 7 mm gauge or less, a 6 mm gauge or less, a 5 mm gauge or less, a 4 mm gauge or less, a 3 mm gauge or less, a 2 mm gauge or less, a 1 mm gauge or less, or a 0.5 mm gauge. In some cases, the percentage reduction in thickness resulting from the hot rolling step can be at least about 30% (e.g., from about 30% to about 50%). For example, the thickness of the cast aluminum alloy product can be reduced by about 30%, about 35%, about 40%, about 45%, about 50%, about 55%, about 60%, about 65%, about 70%, about 75%, or about 80%. In some cases, the aluminum alloy hot band can exit the hot reversing mill and/or the hot tandem mill (i.e., hot mill) at a temperature of from about 300° C. to about 400° C. For example, the aluminum alloy hot band can have a hot mill exit temperature of about 300° C., about 310° C., about 320° C., about 330° C., about 340° C., about 350° C., about 360° C., about 370° C., about 380° C., about 390° C., about 400° C., or anywhere in between.

Coiling and Coil Cooling

Optionally, the aluminum alloy hot band can be coiled into a hot band coil upon exit from the hot mill. In some further examples, the hot band coil is cooled in air (referred to as a coil cooling). The coil cooling step can be performed at a rate of about 12.5° C./hour (° C./h) to about 3600° C./h. For example, the coil cooling step can be performed at a rate of about 12.5° C./h, about 25° C./h, about 50° C./h, about 100° C./h, about 200° C./h, about 400° C./h, about 800° C./h, about 1600° C./h, about 3200° C./h, about 3600° C./h, or anywhere in between. The hot band coil can be cooled to a temperature of from about 200° C. to about 400° C. For example, the hot band coil can be cooled to a temperature of about 200° C., about 210° C., about 220° C., about 230° C., about 240° C., about 250° C., about 260° C., about 270° C., about 280° C., about 290° C., about 300° C., about 310° C., about 320° C., about 330° C., about 340° C., about 350° C., about 360° C., about 370° C., about 380° C., about 390° C., or about 400° C.

In some examples, the air cooled coil can be stored for a period of time. For example, the coil can be maintained at a temperature of about 200° C. to about 400° C. for 1 hour or more (e.g., 2 hours or more, 5 hours or more, 10 hours or more, 1 day or more, 2 days or more, or 1 week or more).

Optional Processing Steps: Homogenization, Hot Rolling to Final Gauge, Coil Cooling, and Cold Rolling to Final Gauge Optionally, a homogenization step can be performed after hot rolling, coiling, and coil cooling. The homogenization step can include heating the hot band coil to attain a peak metal temperature (PMT) of about, or at least about, 450° C. (e.g., at least about 460° C., at least about 470° C., at least about 480° C., at least about 490° C., at least about 500° C., at least about 510° C., at least about 520° C., at least about 530° C., at least about 540° C., at least about 550° C., at least about 560° C., at least about 570° C., or at least about 580° C.). For example, the hot band coil can be heated to a homogenizing temperature of from about 450° C. to about 580° C., from about 460° C. to about 575° C., from about 465° C. to about 570° C., from about 470° C. to about 565° C., from about 475° C. to about 555° C., or from about 480° C. to about 550° C. In some cases, the heating rate to the homogenizing temperature/PMT can be about 100° C./hour or less, about 75° C./hour or less, about 50° C./hour or less, about 40° C./hour or less, about 30° C./hour or less, about 25° C./hour or less, about 20° C./hour or less, or about 15° C./hour or less. In other cases, the heating rate to the homogenizing temperature/PMT can be from about 10° C./min to about 100° C./min (e.g., from about 10° C./min to about 90° C./min, from about 15° C./min to about 70° C./min, from about 20° C./min to about 60° C./min, from about 20° C./min to about 50° C./min, or from about 30° C./min to about 40° C./min).

The hot band coil is then allowed to soak (i.e., held at the indicated temperature) for a period of time. According to one non-limiting example, the hot band coil is allowed to soak for up to about 36 hours (e.g., for about 30 minutes, for about 2 hours, or for about 36 hours). For example, the hot band coil can be soaked at the indicated temperature for 30 minutes, 60 minutes (i.e., 1 hour), 90 minutes, 120 minutes (i.e., 2 hours), 150 minutes, 3 hours, 4 hours, 5 hours, 6 hours, 7 hours, 8 hours, 9 hours, 10 hours, 11 hours, 12 hours, 13 hours, 14 hours, 15 hours, 16 hours, 17 hours, 18 hours, 19 hours, 20 hours, 21 hours, 22 hours, 23 hours, 24 hours, 25 hours, 26 hours, 27 hours, 28 hours, 29 hours, 30 hours, 31 hours, 32 hours, 33 hours, 34 hours, 35 hours, 36 hours, or anywhere in between.

In some non-limiting examples, a homogenization step is not performed.

Optionally, the homogenized hot band coil can be hot rolled to provide a final gauge aluminum alloy product. The hot rolling to final gauge step can be performed after the homogenization step employing, for example, a finishing mill. The hot rolling step can be performed at a hot rolling temperature ranging from about 250° C. to about 500° C. (e.g., from about 300° C. to about 400° C. or from about 350° C. to about 430° C.). For example, the hot rolling step can be performed at a hot rolling temperature of about 250° C., about 260° C., about 270° C., about 280° C., about 290° C., about 300° C., about 310° C., about 320° C., about 330° C., about 340° C., about 350° C., about 360° C., about 370° C., about 380° C., about 390° C., about 400° C., about 410° C., about 420° C., about 430° C., about 440° C., about 450°

C., about 460° C., about 470° C., about 480° C., about 490° C., about 500° C., or anywhere in between.

The hot rolling to final gauge step can further reduce the thickness of the hot band to a final gauge of from about 0.5 mm to about 6 mm. For example, the hot rolling to final gauge step can provide an aluminum alloy product having a gauge of about 6 mm or less, about 5.5 mm or less, about 5 mm or less, about 4.5 mm or less, about 4 mm or less, about 3.5 mm or less, about 3 mm or less, about 2.5 mm or less, about 2 mm or less, about 1.5 mm or less, about 1 mm or less, about 0.5 mm, or anywhere in between.

Optionally, after homogenization, the homogenized hot band coil can undergo coil cooling and cold rolling. The homogenized hot band coil can be cooled in air at a rate of about 12.5° C./hour (° C./h) to about 3600° C./h. For example, the coil cooling step can be performed at a rate of about 12.5° C./h, about 25° C./h, about 50° C./h, about 100° C./h, about 200° C./h, about 400° C./h, about 800° C./h, about 1600° C./h, about 3200° C./h, about 3600° C./h, or anywhere in between. Following the coil cooling, a cold rolling step can optionally be performed. During the cold rolling step, the homogenized hot band coil can be cold rolled to a thickness of from about 0.1 mm to about 6 mm (e.g., from about 0.5 mm to about 5 mm). For example, the homogenized hot band coil can be cold rolled to a thickness of less than about 4 mm to provide a final gauge aluminum alloy product. For example, the final gauge aluminum alloy product can have a thickness of about 6 mm or less, about 5.5 mm or less, about 5 mm or less, about 4.5 mm or less, about 4 mm or less, about 3.5 mm or less, about 3 mm or less, about 2.5 mm or less, about 2 mm or less, about 1.5 mm or less, about 1 mm or less, about 0.5 mm, or anywhere in between. Optionally, the cold rolling step can be performed without a homogenization step and/or a hot rolling step.

In some cases, an exemplary sequence of steps for use in further processing the hot band coil to provide a final gauge aluminum alloy product includes homogenizing the hot band coil to provide a homogenized hot band coil and hot rolling the homogenized hot band coil to provide the final gauge aluminum alloy product. In other cases, an exemplary sequence of steps for use in further processing the hot band coil to provide a final gauge aluminum alloy product includes homogenizing the hot band coil to provide a homogenized hot band coil, cooling the homogenized hot band coil, and cold rolling the homogenized hot band coil to provide a final gauge aluminum alloy product. In still other cases, further processing the hot band coil to provide a final gauge aluminum alloy product includes cold rolling the hot band coil to provide a final gauge aluminum alloy product. In some aspects, further processing the hot band coil to provide a final gauge aluminum alloy product includes coil cooling, cold rolling to a final gauge, solutionizing, paint baking, and aging.

Solutionizing

The methods described herein further include a step of solutionizing the final gauge aluminum alloy product. The solutionizing step can include heating or cooling, as necessary, the final gauge aluminum alloy product to a solutionizing temperature of about 450° C. or greater (e.g., from about 460° C. to about 600° C., from about 465° C. to about 575° C., from about 470° C. to about 550° C., from about 475° C. to about 525° C., or from about 480° C. to about 500° C.). The final gauge aluminum alloy product can soak at the solutionizing temperature for a period of time. In certain aspects, the final gauge aluminum alloy product is allowed to soak for at least 30 seconds (e.g., from about 60 seconds to about 120 minutes, inclusively). For example, the final gauge aluminum alloy product can be soaked at the temperature of about 450° C. or greater for 30 seconds, 35 seconds, 40 seconds, 45 seconds, 50 seconds, 55 seconds, 60 seconds, 65 seconds, 70 seconds, 75 seconds, 80 seconds, 85 seconds, 90 seconds, 95 seconds, 100 seconds, 105 seconds, 110 seconds, 115 seconds, 120 seconds, 125 seconds, 130 seconds, 135 seconds, 140 seconds, 145 seconds, 150 seconds, 5 minutes, 10 minutes, 15 minutes, 20 minutes, 25 minutes, 30 minutes, 35 minutes, 40 minutes, 45 minutes, 50 minutes, 55 minutes, 60 minutes, 65 minutes, 70 minutes, 75 minutes, 80 minutes, 85 minutes, 90 minutes, 95 minutes, 100 minutes, 105 minutes, 110 minutes, 115 minutes, or 120 minutes, or anywhere in between. In certain aspects, the solutionizing is performed immediately after a hot rolling step or a cold rolling step.

Quenching

The methods described herein include a quenching step. The term "quenching," as used herein, can include rapidly reducing a temperature of a final gauge aluminum alloy product that has been solutionized as described above. In the quenching step, the product can be quenched with a liquid (e.g., water), gas, any other suitable quench medium, or any combination thereof. In certain aspects, the product can be quenched using water having a water temperature of between about 40° C. and about 75° C. In certain aspects, the product is quenched using forced air.

In certain aspects, the product can be cooled to a temperature of about 25° C. to about 65° C. at a quench speed that can vary between about 50° C./s to 400° C./s in a quenching step that is based on the selected gauge. For example, the quench rate can be from about 50° C./s to about 375° C./s, from about 60° C./s to about 375° C./s, from about 70° C./s to about 350° C./s, from about 80° C./s to about 325° C./s, from about 90° C./s to about 300° C./s, from about 100° C./s to about 275° C./s, from about 125° C./s to about 250° C./s, from about 150° C./s to about 225° C./s, or from about 175° C./s to about 200° C./s.

Pre-Aging

In some cases, a pre-aging step can be performed. Not to be bound by theory, the pre-aging step can at least partially arrest the mechanical property changes caused by natural aging of the aluminum alloy product. Optionally, the pre-aging step can be performed before the solutionizing step or after the solutionizing step. The pre-aging step can include heating the final gauge aluminum alloy product to a pre-aging temperature of from about 50° C. to about 150° C. (e.g., from about 55° C. to about 140° C., from about 60° C. to about 130° C., from about 65° C. to about 120° C., or from about 70° C. to about 110° C.). For example, the pre-aging step can include heating the final gauge aluminum alloy product to a temperature of about 50° C., about 55° C., about 60° C., about 65° C., about 70° C., about 75° C., about 80° C., about 85° C., about 90° C., about 95° C., about 100° C., about 105° C., about 110° C., about 115° C., about 120° C., about 125° C., about 130° C., about 135° C., about 140° C., about 145° C., or about 150° C. The final gauge aluminum alloy product can be maintained at the pre-aging temperature for a period of up to about 24 hours (e.g., from about 1 hour to about 24 hours). For example, the final gauge aluminum alloy product can be maintained for about 24 hours or less, about 12 hours or less, about 6 hours or less, about 5 hours or less, about 4 hours or less, about 3 hours or less, about 2 hours or less, about 1 hour or less, or anywhere in between.

Aging

After the solutionizing, quenching and/or pre-aging steps, one or more aging steps can be performed. The aging can include one or more of natural aging, artificial aging, paint baking, and post-forming heat treating.

Optionally, the aging can include a natural aging step. The natural aging can include a step of maintaining the final gauge aluminum alloy product at room temperature for a period of time. For example, the final gauge aluminum alloy product can be maintained at room temperature for up to about 12 weeks (e.g., about 1 day, about 2 days, about 3 days, about 4 days, about 5 days, about 6 days, about 1 week, about 2 weeks, about 3 weeks, about 4 weeks, about 5 weeks, about 6 weeks, about 7 weeks, about 8 weeks, about 9 weeks, about 10 weeks, about 11 weeks, or about 12 weeks).

Aluminum alloy products prepared according to the methods described herein can be delivered after being subjected to the optional pre-aging and natural aging. The aluminum alloy products can achieve high yield strengths after processing by an end user, for example, by deforming (e.g., stamping, pressing, forming, or any suitable deforming process) and/or by aging or thermal treatment (e.g., coating and paint baking, artificial aging, post-forming heat treatment, or any suitable end user thermal treatment). Optionally, after the optional pre-aging and/or natural aging step, the aluminum alloy products described herein are subjected to, for example, a forming process, a coating process, an artificial aging step, and/or a paint baking process.

Optionally, the aging can include an artificial aging step. The artificial aging can include heating the final gauge aluminum alloy product to an artificial aging temperature of from about 100° C. to about 250° C. (e.g., from about 110° C. to about 220° C., from about 115° C. to about 210° C., or from about 125° C. to about 200° C.). The artificial aging step can include maintaining the artificial aging temperature for a period of from about 1 hour to about 72 hours (e.g., about 1 hour, about 2 hours, about 3 hours, about 4 hours, about 5 hours, about 6 hours, about 7 hours, about 8 hours, about 9 hours, about 10 hours, about 11 hours, about 12 hours, about 24 hours, about 48 hours, about 60 hours, or about 72 hours).

In some aspects, an optional coating procedure can be performed (e.g., painting, electrocoating, or zinc-phosphating, to name a few). After coating, the final gauge aluminum alloy product can be subjected to further thermal treatment including paint baking, post-forming heat treatment, any suitable OEM thermal treatment process, or any combination thereof. The paint baking can further strengthen the aluminum alloy product providing a high strength aluminum alloy product having an optionally complex formed shape. In some cases, a paint baking procedure can include heating the aluminum alloy product to a paint baking temperature of from about 75° C. to about 250° C. and maintaining the aluminum alloy product at the paint baking temperature for a period of up to about 3 hours (e.g., from about 15 minutes to 2 hours or from about 30 minutes to about 1 hour). In some further cases, a post-forming heat treatment can be performed. The post-forming heat treatment procedure can include heating the final gauge aluminum alloy product to a post-forming heat treating temperature of from about 100° C. to about 250° C. and maintaining this temperature for about 1 hour to about 24 hours (e.g., from about 2 hours to about 12 hours).

Alloy Product Properties

The aluminum alloy products described herein can have high strength and formability properties, before and after aging as described herein. Tensile testing of samples is conducted according to standard procedures known in the area of material science described in relevant publications, such as those provided by the American Society for Testing and Materials (ASTM). ASTM E8/EM8 (DOI: 10.1520/E0008 E0008M-15A) entitled "Standard Test Methods for Tension Testing of Metallic Materials" specifies tensile testing procedures for metallic materials.

In some cases, the aluminum alloy product achieves an increase in elongation and an increase in yield strength after aging as compared to an elongation and a yield strength achieved by the aluminum alloy product before aging. The increase in elongation can be at least about 1% (e.g., from about 1.5% to about 5% or from about 2% to about 3%). For example, the increase in elongation can be about 1%, about 1.5%, about 2%, about 2.5%, about 3%, about 3.5%, about 4%, about 4.5%, about 5%, or greater than about 5%. The increase in yield strength can be at least about 15 MPa (e.g., from about 15 MPa to about 25 MPa). For example, the increase in yield strength can be about 15 MPa, about 16 MPa, about 17 MPa, about 18 MPa, about 19 MPa, about 20 MPa, about 21 MPa, about 22 MPa, about 23 MPa, about 24 MPa, about 25 MPa, or greater than about 25 MPa.

In some examples, the aluminum alloy products provided in a T6 temper have a yield strength of greater than about 400 MPa after processing according to the methods described herein. For example, the aluminum alloy products can have a yield strength of 400 MPa or greater, 405 MPa or greater, 410 MPa or greater, 415 MPa or greater, 420 MPa or greater, 425 MPa or greater, 430 MPa or greater, 435 MPa or greater, 440 MPa or greater, 445 MPa or greater, 450 MPa or greater, 455 MPa or greater, 460 MPa or greater, 465 MPa or greater, 470 MPa or greater, 475 MPa or greater, 480 MPa or greater, 485 MPa or greater, 490 MPa or greater, 495 MPa or greater, 500 MPa or greater, 505 MPa or greater, 510 MPa or greater, 515 MPa or greater, 520 MPa or greater, 525 MPa or greater, 530 MPa or greater, 535 MPa or greater, 540 MPa or greater, 545 MPa or greater, 550 MPa or greater, 555 MPa or greater, 560 MPa or greater, 565 MPa or greater, 570 MPa or greater, or 575 MPa or greater, after processing according to the methods described herein.

In some cases, the aluminum alloy products provided in a T4 temper have a yield strength of greater than about 240 MPa after processing according to the methods described herein. For example, the aluminum alloy products can have a yield strength of about 240 MPa or greater, about 250 MPa or greater, about 260 MPa or greater, about 270 MPa or greater, about 280 MPa or greater, about 290 MPa or greater, about 300 MPa or greater, about 310 MPa or greater, about 320 MPa or greater, about 330 MPa or greater, about 340 MPa or greater, about 350 MPa or greater, about 360 MPa or greater, about 370 MPa or greater, about 380 MPa or greater, about 390 MPa or greater, about 400 MPa or greater, about 410 MPa or greater, about 420 MPa or greater, or about 425 MPa or greater.

In some examples, the aluminum alloy products have a uniform elongation of greater than about 6% when provided in a T6 temper after processing according to the methods described herein. For example, the aluminum alloy products in a T6 temper can have a uniform elongation of about 6%, about 6.1%, about 6.2%, about 6.3%, about 6.4%, about 6.5%, about 6.6%, about 6.7%, about 6.8%, about 6.9%, about 7%, about 7.1%, about 7.2%, about 7.3%, about 7.4%, about 7.5%, about 7.6%, about 7.7%, about 7.8%, about 7.9%, about 8%, about 8.1%, about 8.2%, about 8.3%, about 8.4%, about 8.5%, about 8.6%, about 8.7%, about 8.8%, about 8.9%, about 9%, about 9.1%, about 9.2%, about 9.3%, about 9.4%, about 9.5%, about 9.6%, about 9.7%, about 9.8%, about 9.9%, about 10%, about 10.1%, about 10.2%, about 10.3%, about 10.4%, about 10.5%, about 10.6%, about 10.7%, about 10.8%, about 10.9%, about 11%, about 11.1%, about 11.2%, about 11.3%, about 11.4%, about 11.5%, about 11.6%, about 11.7%, about 11.8%, about 11.9%, about 12%, about 12.1%, about 12.2%, about 12.3%, about 12.4%, about 12.5%, about 12.6%, about 12.7%, about 12.8%, about 12.9%, about 13%, about 13.1%, about 13.2%, about 13.3%, about 13.4%, about 13.5%, about 13.6%, about 13.7%, about 13.8%, about 13.9%, about 14%, about 14.1%, about 14.2%, about 14.3%, about 14.4%, about 14.5%, about 14.6%, about 14.7%, about 14.8%, about 14.9%, about 15%, about 15.1%, about 15.2%, about 15.3%, about 15.4%, about 15.5%, about 15.6%, about 15.7%, about 15.8%, about 15.9%, about 16%, about 16.1%, about 16.2%, about 16.3%, about 16.4%, about 16.5%, about 16.6%, about 16.7%, about 16.8%, about 16.9%, about 17%, about 17.1%, about 17.2%, about 17.3%, about 17.4%, about 17.5%, about 17.6%, about 17.7%, about 17.8%, about 17.9%, about 18%, about 18.1%, about 18.2%, about 18.3%, about 18.4%, about 18.5%, about 18.6%, about 18.7%, about 18.8%, about 18.9%, about 19%, about 19.1%, about 19.2%, about 19.3%, about 19.4%, about 19.5%, about 19.6%, about 19.7%, about 19.8%, about 19.9%, or about 20%.

In some examples, the aluminum alloy products have a uniform elongation of greater than about 16% when provided in a T4 temper after processing according to the methods described herein. For example, the aluminum alloy products in a T4 temper can have a uniform elongation of about 16%, about 16.1%, about 16.2%, about 16.3%, about 16.4%, about 16.5%, about 16.6%, about 16.7%, about 16.8%, about 16.9%, about 17%, about 17.1%, about 17.2%, about 17.3%, about 17.4%, about 17.5%, about 17.6%, about 17.7%, about 17.8%, about 17.9%, about 18%, about 18.1%, about 18.2%, about 18.3%, about 18.4%, about 18.5%, about 18.6%, about 18.7%, about 18.8%, about 18.9%, about 19%, about 19.1%, about 19.2%, about 19.3%, about 19.4%, about 19.5%, about 19.6%, about 19.7%, about 19.8%, about 19.9%, about 20%, about 20.1%, about 20.2%, about 20.3%, about 20.4%, about 20.5%, about 20.6%, about 20.7%, about 20.8%, about 20.9%, about 21%, about 21.1%, about 21.2%, about 21.3%, about 21.4%, about 21.5%, about 21.6%, about 21.7%, about 21.8%, about 21.9%, about 22%, about 22.1%, about 22.2%, about 22.3%, about 22.4%, about 22.5%, about 22.6%, about 22.7%, about 22.8%, about 22.9%, about 23%, about 23.1%, about 23.2%, about 23.3%, about 23.4%, about 23.5%, about 23.6%, about 23.7%, about 23.8%, about 23.9%, about 24%, about 24.1%, about 24.2%, about 24.3%, about 24.4%, about 24.5%, about 24.6%, about 24.7%, about 24.8%, about 24.9%, about 25%, about 25.1%, about 25.2%, about 25.3%, about 25.4%, about 25.5%, about 25.6%, about 25.7%, about 25.8%, about 25.9%, about 26%, about 26.1%, about 26.2%, about 26.3%, about 26.4%, about 26.5%, about 26.6%, about 26.7%, about 26.8%, about 26.9%, about 27%, about 27.1%, about 27.2%, about 27.3%, about 27.4%, about 27.5%, about 27.6%, about 27.7%, about 27.8%, about 27.9%, about 28%, about 28.1%, about 28.2%, about 28.3%, about 28.4%, about 28.5%, about 28.6%, about 28.7%, about 28.8%, about 28.9%, about 29%, about 29.1%, about 29.2%, about 29.3%, about 29.4%, about 29.5%, about 29.6%, about 29.7%, about 29.8%, about 29.9%, or about 30%.

The aluminum alloy products described herein can have excellent bendability properties, before and after aging as described herein. The aluminum alloy products prepared according to the methods described herein exhibit desired bendability properties as measured by a three-point bend test according to ISO 7438 (general bending standard) and VDA 238-100. For example, the aluminum alloy products can have a VDA a bend angle of greater than about 65°. In some cases, the aluminum alloy products can have a VDA a bend angle of about 65°, about 65.1°, about 65.2°, about 65.3°, about 65.4°, about 65.5°, about 65.6°, about 65.7°, about 65.8°, about 65.9°, about 66°, about 66.1°, about 66.2°, about 66.3°, about 66.4°, about 66.5°, about 66.6°, about 66.7°, about 66.8°, about 66.9°, about 67°, about 67.1°, about 67.2°, about 67.3°, about 67.4°, about 67.5°, about 67.6°, about 67.7°, about 67.8°, about 67.9°, about 68°, about 68.1°, about 68.2°, about 68.3°, about 68.4°, about 68.5°, about 68.6°, about 68.7°, about 68.8°, about 68.9°, about 69°, about 69.1°, about 69.2°, about 69.3°, about 69.4°, about 69.5°, about 69.6°, about 69.7°, about 69.8°, about 69.9°, about 70°, about 70.1°, about 70.2°, about 70.3°, about 70.4°, about 70.5°, about 70.6°, about 70.7°, about 70.8°, about 70.9°, about 71°, about 71.1°, about 71.2°, about 71.3° about 71.4°, about 71.5°, about 71.6°, about 71.7°, about 71.8°, about 71.9°, about 72°, about 72.1°, about 72.2°, about 72.3°, about 72.4°, about 72.5°, about 72.6°, about 72.7°, about 72.8°, about 72.9°, about 73°, about 73.1°, about 73.2°, about 73.3°, about 73.4°, about 73.5°, about 73.6°, about 73.7°, about 73.8°, about 73.9°, about 74°, about 74.1°, about 74.2°, about 74.3°, about 74.4°, about 74.5°, about 74.6°, about 74.7°, about 74.8°, about 74.9°, about 75°, about 75.1°, about 75.2°, about 75.3°, about 75.4°, about 75.5°, about 75.6°, about 75.7°, about 75.8°, about 75.9°, about 76°, about 76.1°, about 76.2°, about 76.3°, about 76.4°, about 76.5°, about 76.6°, about 76.7°, about 76.8°, about 76.9°, about 77°, about 77.1°, about 77.2°, about 77.3°, about 77.4°, about 77.5°, about 77.6°, about 77.7°, about 77.8°, about 77.9°, about 78°, about 78.1°, about 78.2°, about 78.3°, about 78.4°, about 78.5°, about 78.6°, about 78.7°, about 78.8°, about 78.9°, about 79°, about 79.1°, about 79.2°, about 79.3°, about 79.4°, about 79.5°, about 79.6°, about 79.7°, about 79.8°, about 79.9°, about 80°, about 80.1°, about 80.2°, about 80.3°, about 80.4°, about 80.5°, about 80.6°, about 80.7°, about 80.8°, about 80.9°, about 81°, about 81.1°, about 81.2°, about 81.3°, about 81.4°, about 81.5°, about 81.6°, about 81.7°, about 81.8°, about 81.9°, about 82°, about 82.1°, about 82.2°, about 82.3°, about 82.4°, about 82.5°, about 82.6°, about 82.7°, about 82.8°, about 82.9°, about 83°, about 83.1°, about 83.2°, about 83.3°, about 83.4°, about 83.5°, about 83.6°, about 83.7°, about 83.8°, about 83.9°, about 84°, about 84.1°, about 84.2°, about 84.3°, about 84.4°, about 84.5°, about 84.6°, about 84.7°, about 84.8°, about 84.9°, about 85°, about 85.1°, about 85.2°, about 85.3°, about 85.4°, about 85.5°, about 85.6°, about 85.7°, about 85.8°, about 85.9°, about 86°, about 86.1°, about 86.2°, about 86.3°, about 86.4°, about 86.5°, about 86.6°, about 86.7°, about 86.8°, about 86.9°, about 87°, about 87.1°, about 87.2°, about 87.3°, about 87.4°, about 87.5°, about 87.6°, about 87.7°, about 87.8°, about 87.9°, about 88°, about 88.1°, about 88.2°, about 88.3°, about 88.4°, about 88.5°, about 88.6°, about 88.7°, about 88.8°, about 88.9°, about 89°, about 89.1°, about 89.2°, about 89.3°, about 89.4°, about 89.5°, about 89.6°, about 89.7°, about 89.8°, about 89.9°, or about 90°.

Methods of Using

The alloy products and methods described herein can be used in automotive and/or transportation applications, including motor vehicle, aircraft, and railway applications, or any other desired application. In some examples, the products and methods can be used to prepare motor vehicle body part products, such as bumpers, side beams, roof beams, cross beams, pillar reinforcements (e.g., A-pillars, B-pillars, and C-pillars), inner panels, outer panels, side panels, inner hoods, outer hoods, or trunk lid panels. The aluminum alloy products and methods described herein can also be used in aircraft or railway vehicle applications, to prepare, for example, external and internal panels.

The products and methods described herein can also be used in electronics applications, to prepare, for example, external and internal encasements. For example, the products and methods described herein can also be used to prepare housings for electronic devices, including mobile phones and tablet computers. In some examples, the products can be used to prepare housings for the outer casing of mobile phones (e.g., smart phones) and tablet bottom chassis.

In certain aspects, the products and methods can be used to prepare aerospace vehicle body part products. For example, the disclosed products and methods can be used to prepare airplane body parts, such as skin alloys. The products and methods can be used in any other desired application.

ILLUSTRATIONS

Illustration 1 is a method of producing a formable high strength aluminum alloy product, comprising continuously casting a molten aluminum alloy composition to provide a cast aluminum alloy product having a casting exit temperature, wherein the molten aluminum alloy composition comprises an aluminum alloy comprising at least 0.1 wt. % Zr, at least 2 wt. % Mg, and Zn as a predominate alloying element other than Al; cooling the cast aluminum alloy product to a temperature of from 20° C. to 50° C. below the casting exit temperature to provide a thermally stabilized cast aluminum alloy product; hot rolling the thermally stabilized cast aluminum alloy product to provide an aluminum alloy hot band; coiling the aluminum alloy hot band to provide a hot band coil; cooling the hot band coil to a temperature of from 200° C. to 400° C.; further processing the hot band coil to provide a final gauge aluminum alloy product; and solutionizing the final gauge aluminum alloy product.

Illustration 2 is the method of any preceding or subsequent illustration, wherein the molten aluminum alloy composition comprises a Zn to Mg ratio of from about 1.2 to about 3.

Illustration 3 is the method of any preceding or subsequent illustration, wherein the hot rolling comprises heating the thermally stabilized cast aluminum alloy product to a hot rolling entry temperature.

Illustration 4 is the method of any preceding or subsequent illustration, wherein hot rolling the thermally stabilized cast aluminum alloy product is performed to reduce a thickness of the thermally stabilized cast aluminum alloy product by at least 30%.

Illustration 5 is the method of any preceding or subsequent illustration, wherein the thickness of the cast aluminum alloy product is reduced by 40% to 50%.

Illustration 6 is the method of any preceding or subsequent illustration, wherein the further processing comprises homogenizing the hot band coil to provide a homogenized hot band coil; and hot rolling the homogenized hot band coil to provide the final gauge aluminum alloy product.

Illustration 7 is the method of any preceding or subsequent illustration, wherein the further processing comprises homogenizing the hot band coil to provide a homogenized hot band coil; cooling the homogenized hot band coil; and cold rolling the homogenized hot band coil to provide a final gauge aluminum alloy product.

Illustration 8 is the method of any preceding or subsequent illustration, wherein the homogenizing comprises heating the aluminum alloy hot band to a homogenizing temperature of at least 450° C. and maintaining the aluminum alloy hot band at the homogenizing temperature of at least 450° C. for a time period of at least about 90 minutes.

Illustration 9 is the method of any preceding or subsequent illustration, wherein the further processing comprises cold rolling the hot band coil to provide a final gauge aluminum alloy product.

Illustration 10 is the method of any preceding or subsequent illustration, further comprising pre-aging the final gauge aluminum alloy product, wherein the pre-aging comprises heating the final gauge aluminum alloy product to a pre-aging temperature of from about 50° C. to about 150° C. and maintaining the pre-aging temperature for a period of from about 1 hour to about 24 hours.

Illustration 11 is the method of any preceding or subsequent illustration, further comprising aging the final gauge aluminum alloy product to achieve a yield strength of at least 400 MPa.

Illustration 12 is the method of any preceding or subsequent illustration, wherein the aging comprises one or more of natural aging, artificial aging, paint baking, and post-forming heat treating.

Illustration 13 is the method of any preceding or subsequent illustration, wherein the aging comprises natural aging and the natural aging comprises maintaining the final gauge aluminum alloy product at room temperature for a period of from about 1 day to about 12 weeks.

Illustration 14 is the method of any preceding or subsequent illustration, wherein the aging comprises artificial aging and the artificial aging comprises heating the final gauge aluminum alloy product to an artificial aging temperature of from about 100° C. to about 250° C. and maintaining the artificial aging temperature for a period of from about 1 hour to about 72 hours.

Illustration 15 is the method of any preceding or subsequent illustration, wherein the aging comprises paint baking and the paint baking comprises heating the final gauge aluminum alloy product to a paint baking temperature of from about 75° C. to about 250° C. and maintaining the paint baking temperature for a period of from about 15 minutes to about 3 hours.

Illustration 16 is the method of any preceding or subsequent illustration, wherein the aging comprises post-forming heat treating and the post-forming heat treating comprises heating the final gauge aluminum alloy product to a post-forming heat treating temperature of from about 100° C. to about 250° C. and maintaining the post-forming heat treating temperature for a period of from about 1 hour to about 24 hours.

Illustration 17 is an aluminum alloy product prepared according to the method of any preceding or subsequent illustration.

Illustration 18 is the aluminum alloy product of any preceding or subsequent illustration, wherein the aluminum alloy product achieves an increase in elongation and an increase in yield strength after aging.

Illustration 19 is the aluminum alloy product of any preceding or subsequent illustration, wherein the increase in elongation is at least about 1%.

Illustration 20 is the aluminum alloy product of any preceding or subsequent illustration, wherein the increase in elongation is from about 1.5% to about 5%.

Illustration 21 is the aluminum alloy product of any preceding or subsequent illustration, wherein the increase in yield strength is at least about 15 MPa.

Illustration 22 is the aluminum alloy product of any preceding or subsequent illustration, wherein the increase in yield strength is from about 15 MPa to about 25 MPa.

Illustration 23 is the aluminum alloy product of any preceding illustration, wherein the increase in elongation is at least about 1% and the increase in yield strength is at least about 15 MPa.

The following examples will serve to further illustrate the present invention without, however, constituting any limitation thereof. On the contrary, it is to be clearly understood that resort may be had to various embodiments, modifications, and equivalents thereof which, after reading the description herein, may suggest themselves to those skilled in the art without departing from the spirit of the invention.

EXAMPLES

Example 1: Methods of Preparing and Producing Highly Formable High Strength Aluminum Alloys An aluminum alloy processing method as described herein includes hot rolling, coil cooling, homogenizing, hot rolling to a final gauge, and solutionizing (referred to herein as "Route 1"). FIG. 1A is a schematic depicting the Route 1 processing method 100. A continuous caster 110 was employed to produce an aluminum alloy slab 120. The aluminum alloy slab 120 exited the continuous caster 110 at a temperature of from about 400° C. to about 430° C. The aluminum alloy slab 120 was then processed in a hot mill 130 to reduce the thickness of the aluminum alloy slab 120 by about 40% to about 50% to produce a hot band 125. The hot band 125 was subsequently coiled at a temperature of about 350° C. and the coil 140 was then subjected to further processing. The coil 140 was subsequently homogenized in a box furnace 150 at a homogenizing temperature of about 480° C. for about 2 hours. After homogenizing, the coil 140 was uncoiled and the hot band 125 was further hot rolled in a finishing mill 160 to produce a final gauge aluminum alloy product 127. The final gauge aluminum alloy product 127 was then coiled and the aluminum alloy product coil 170 was then subjected to a solutionizing process. In some cases, the aluminum alloy product coil was subjected to a pre-aging process before the solutionizing step. In some examples, the aluminum alloy product coil was subjected to other aging processes after the solutionizing step.

Figure 1B:
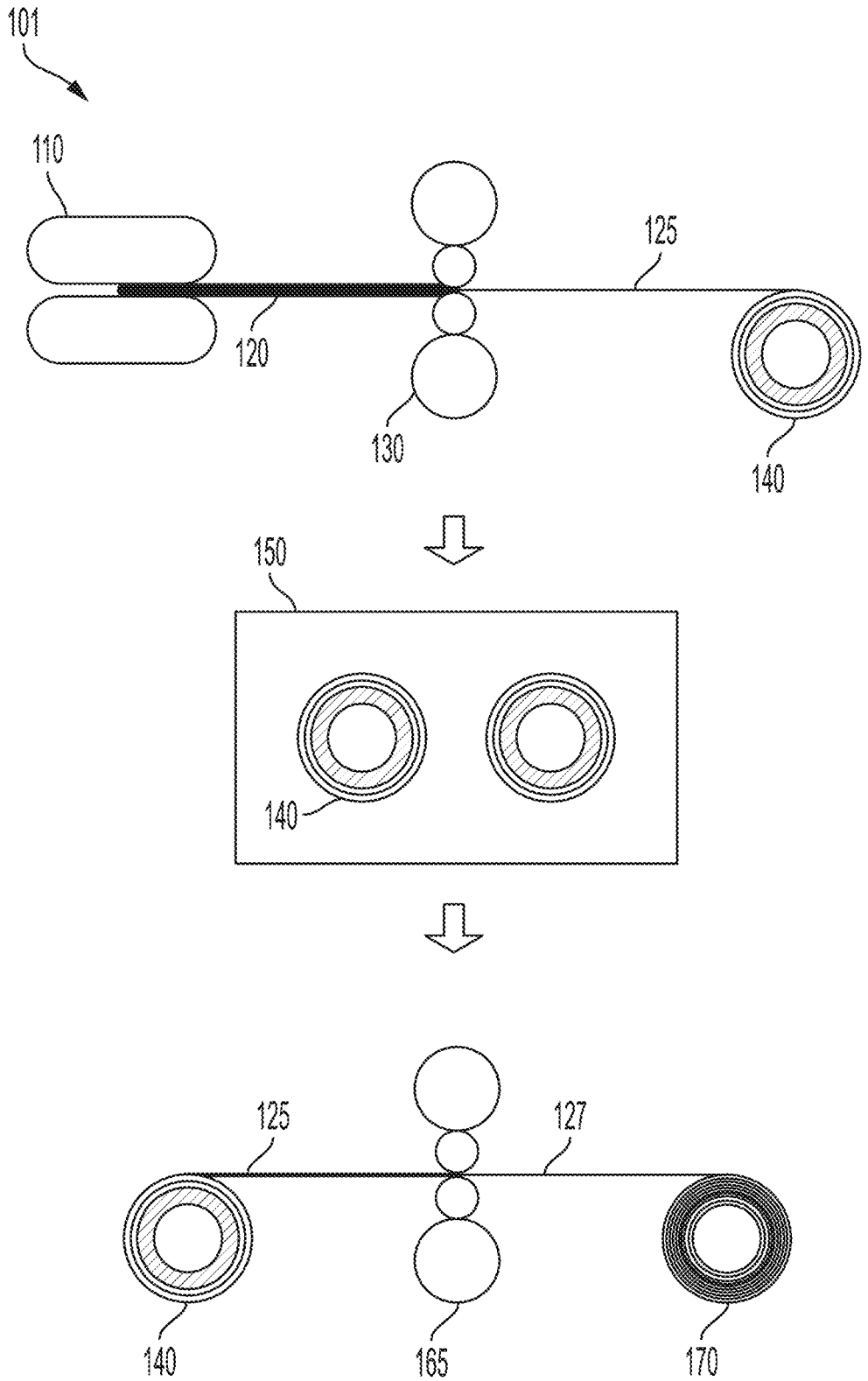
FIG. 1B is a schematic diagram depicting an aluminum alloy processing method described herein.

Another aluminum alloy processing method as described herein includes hot rolling, coil cooling, homogenizing, coil cooling, cold rolling, and solutionizing (referred to herein as "Route 2"). FIG. 1B is a schematic depicting the Route 2 processing method 101. Casting, hot rolling, coiling, coil cooling, and homogenizing were performed as described above. After homogenizing, the coil 140 was uncoiled and the hot band 125 was cold rolled in a cold mill 165 to produce the final gauge aluminum alloy product 127. The final gauge aluminum alloy product 127 was then coiled and the aluminum alloy product coil 170 was subjected to a solutionizing process. In some cases, the aluminum alloy product coil was subjected to a pre-aging process or other aging process.

Figure 1C:
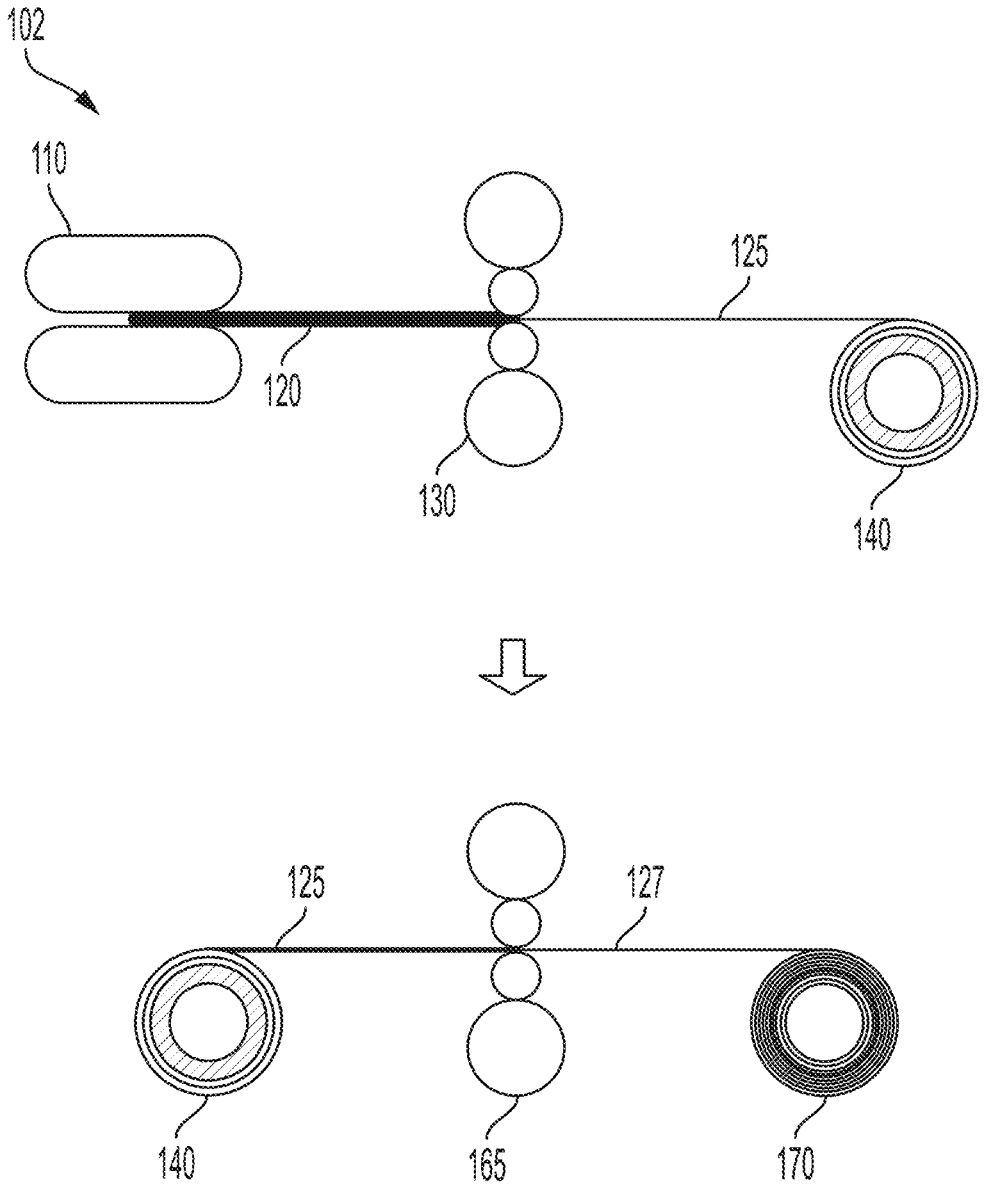
FIG. 1C is a schematic diagram depicting an aluminum alloy processing method described herein.

Another aluminum alloy processing method as described herein includes hot rolling, coil cooling, cold rolling, and solutionizing (referred to herein as "Route 3"). FIG. 1C is a schematic depicting the Route 3 processing method 102. Casting, hot rolling, coiling, and coil cooling were performed as described above to result in the coil 140. After coil cooling, the coil 140 was uncoiled and the hot band 125 was cold rolled in a cold mill 165 to produce a final gauge aluminum alloy product 127. The final gauge aluminum alloy product 127 was then coiled and the aluminum alloy product coil 170 was then subjected to a solutionizing process. In some cases, the aluminum alloy product coil 170 was subjected to a pre-aging process or other aging process.

Example 2: Mechanical Properties of Highly Formable High Strength Aluminum Alloys A cast aluminum alloy product was prepared, using a continuous caster, from an aluminum alloy composition including 0.60 wt. % Cu, 0.20 wt. % Fe, 3.50 wt. % Mg, 0.10 wt. % Mn, 0.05 wt. % Si, 0.02 wt. % Ti, 0.10 wt. % Cr, 4.50 wt. % Zn, 0.12 wt. % Zr, up to 0.15 wt. % impurities, and the remainder aluminum (referred to herein as "Alloy A"). Alloy A had a Zn/Mg ratio of about 1.3. Samples taken from Alloy A, prepared and produced according to the methods described in Example 1, were subjected to mechanical testing. Route 1, Route 2, and Route 3 (see Example 1) were all employed with and without pre-aging. In some cases, an additional paint baking step was employed, in which the aluminum alloy product was heated to a temperature of about 180° C. and maintained at this temperature for about 30 minutes.

Figure 2:
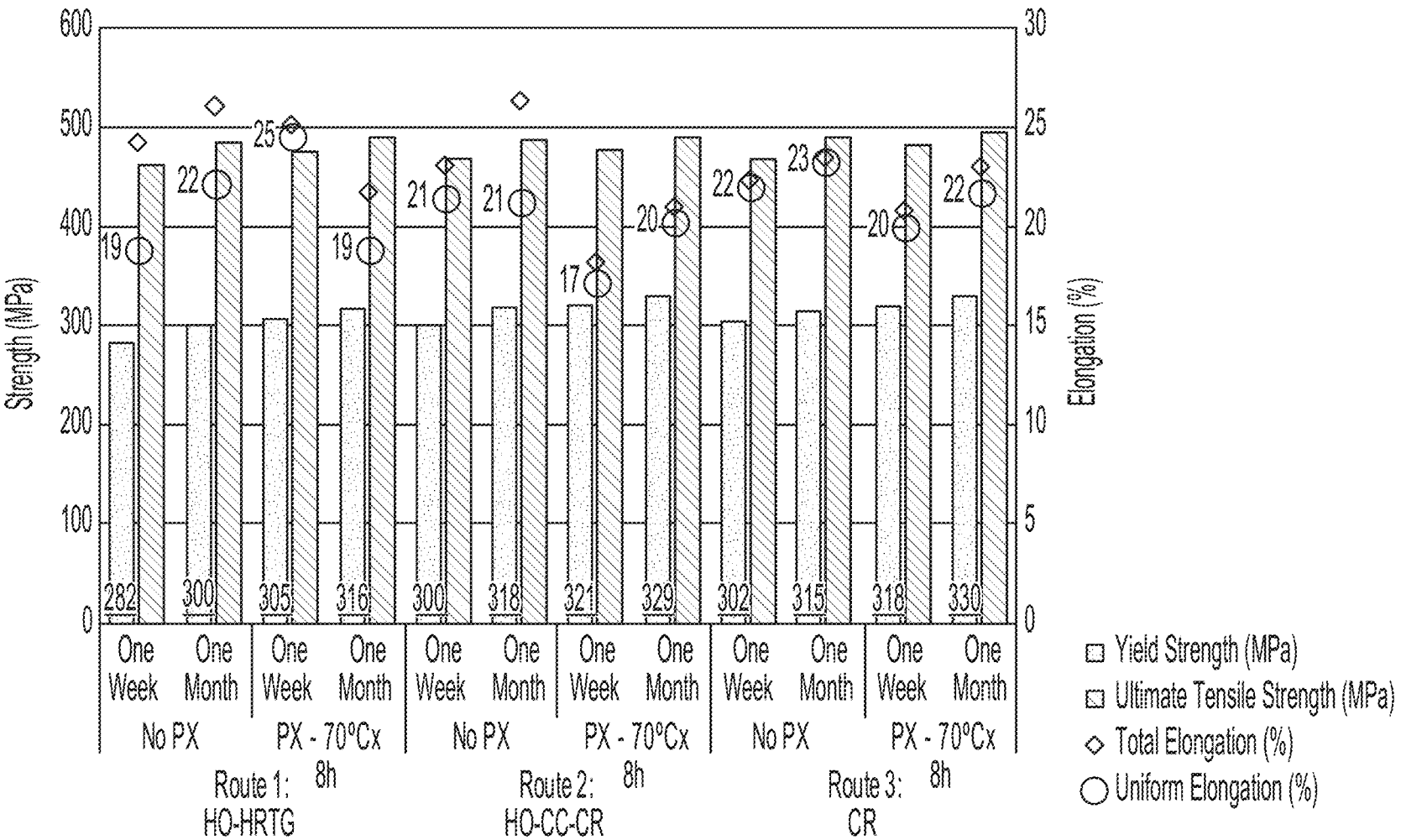
FIG. 2 is a graph showing strength and elongation properties of aluminum alloy products processed by methods described herein.

FIG. 2 is a summary graph showing the mechanical properties of Alloy A prepared and processed according to methods described herein, without pre-aging ("No PX"), and with pre-aging ("PX") by heating the final gauge aluminum alloy product 127 to a temperature of about 70° C. and maintaining this temperature for about 8 hours before solutionizing. After solutionizing, the Alloy A samples were naturally aged for 1 week. As shown in the graph, the yield strength (left solid histogram in each pair) for each sample ranged from about 280 MPa to about 325 MPa, regardless of processing route or whether pre-aging was employed. The ultimate tensile strength (right hatched histogram in each pair) ranged from about 450 MPa to about 500 MPa for each aluminum alloy product sample. The uniform elongation (open circles) and total elongation (open diamonds) ranged from about 17% to about 25% for each sample.

Figure 3:
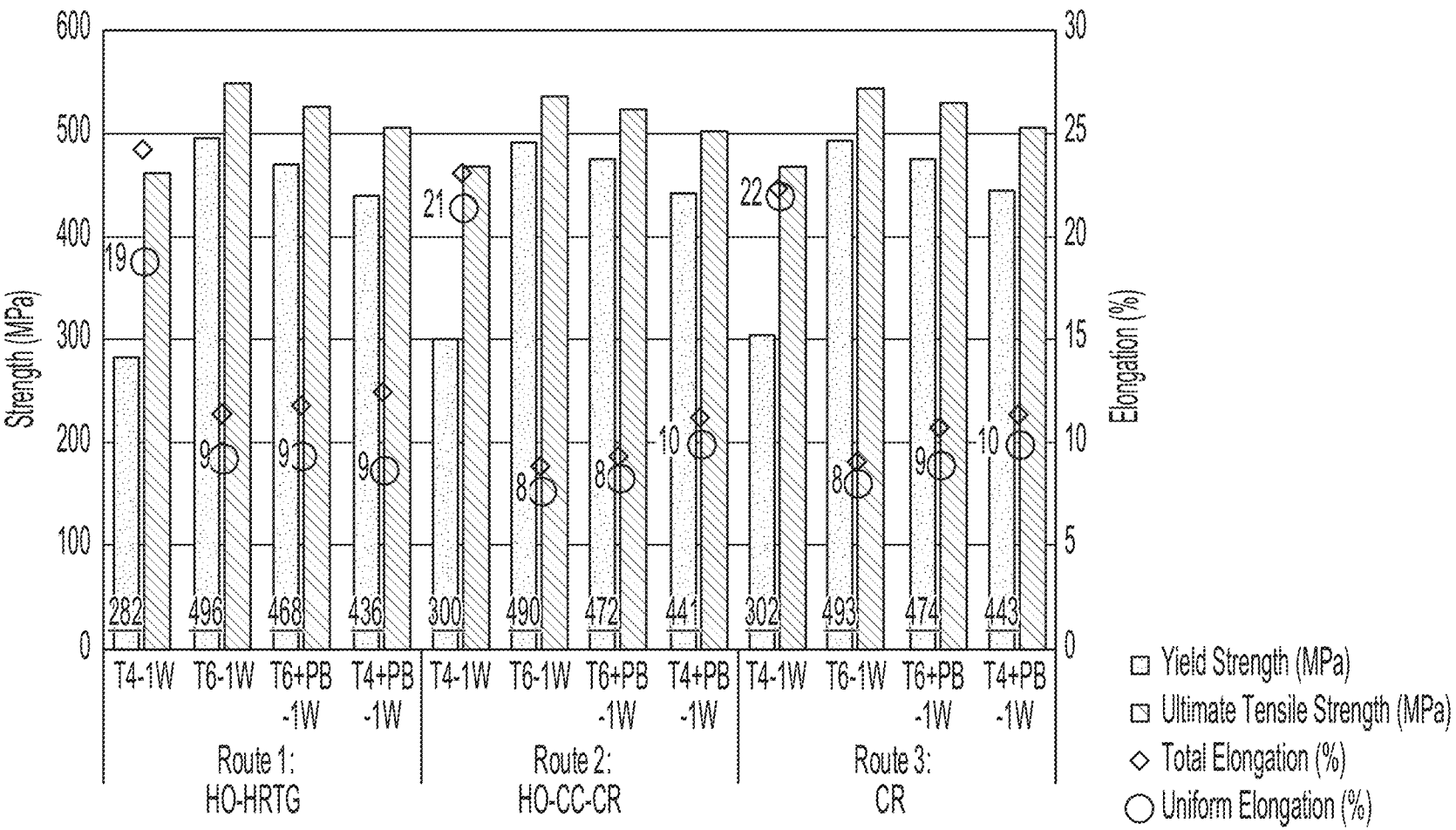
FIG. 3 is a graph showing strength and elongation properties of aluminum alloy products processed by methods described herein.

FIG. 3 is a graph showing the mechanical properties of Alloy A prepared and processed according to Route 1 (referred to as "HO-HRTG"), Route 2 (referred to as "HO-CC-CR"), and Route 3 (referred to as "CR") described herein, without pre-aging, and 1 week of natural aging to provide samples in a T4 temper (referred to as "T4-1W"). Additionally, artificial aging was performed by heating the samples to about 125° C. and maintaining this temperature for 24 hours to produce samples in a T6 temper (referred to as "T6-1W"). A paint baking procedure as described above was employed for certain samples (referred to as "T4+PB-1W" for the T4 samples and as "T6+PB-1W" for the T6 samples). As shown in FIG. 3, the yield strength (left solid histogram in each pair) for each sample significantly increased after artificial aging regardless of the processing route. The ultimate tensile strength (right hatched histogram in each pair) also increased for each aluminum alloy product sample. The uniform elongation (open circles) and total elongation (open diamonds) significantly decreased for each sample.

Figure 4:
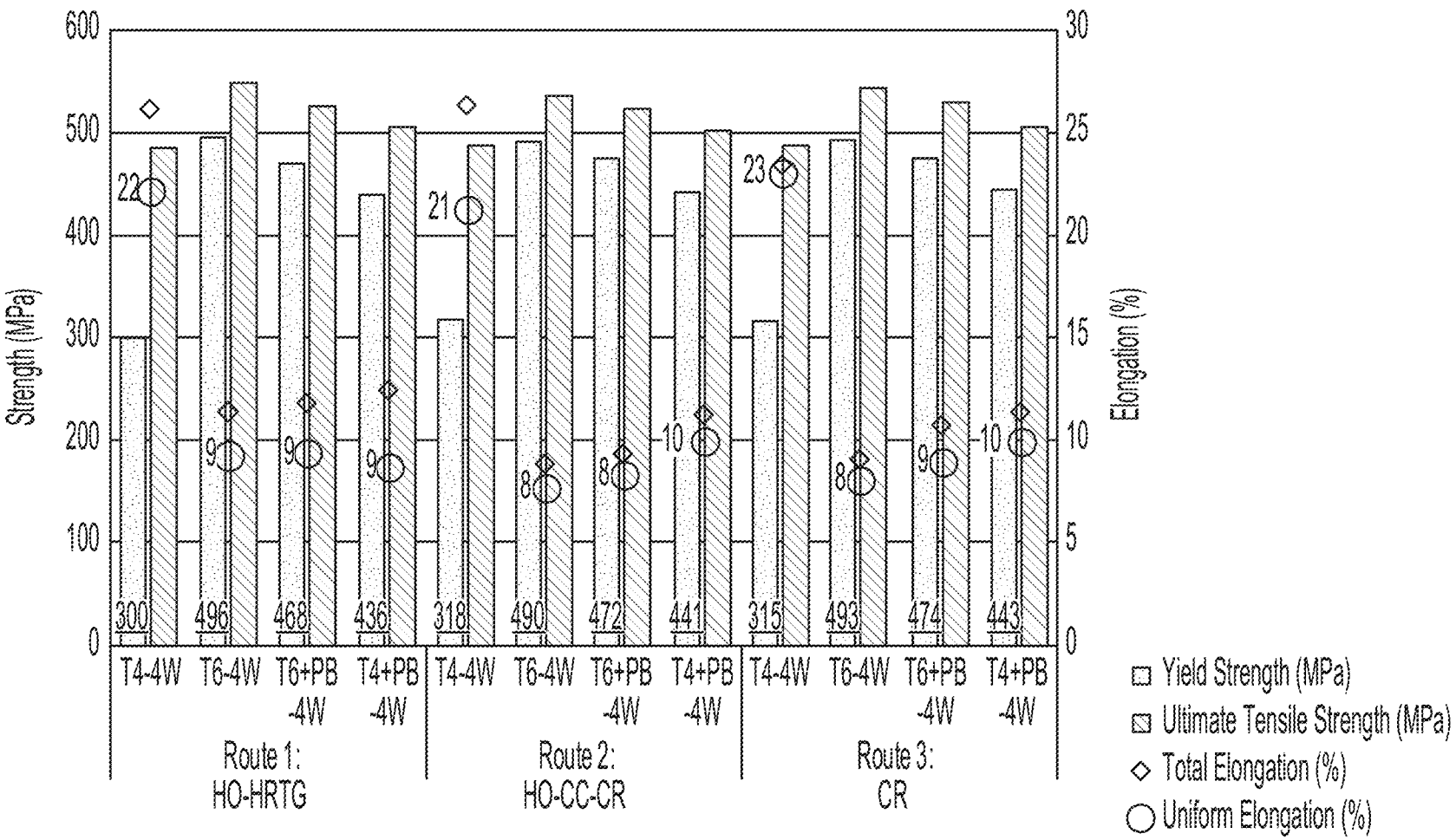
FIG. 4 is a graph showing strength and elongation properties of aluminum alloy products processed by methods described herein.

FIG. 4 is a graph showing the mechanical properties of Alloy A prepared and processed according to Route 1 (referred to as "HO-HRTG"), Route 2 (referred to as "HO-CC-CR"), and Route 3 (referred to as "CR") described herein, without pre-aging, and 4 weeks of natural aging to provide samples in a T4 temper (referred to as "T4-4W"). Additionally, artificial aging was performed by heating the samples to about 125° C. and maintaining this temperature for 24 hours to produce samples in a T6 temper (referred to as "T6-4W"). A paint baking procedure as described above was employed for certain samples (referred to as "T4+PB-4W" for the T4 samples and as "T6+PB-4W" for the T6 samples). As shown in FIG. 4, additional natural aging slightly increased both yield strength (left solid histogram in each pair) and ultimate tensile strength (right hatched histogram in each pair). Surprisingly, formability (i.e., uniform elongation (open circles) and total elongation (open diamonds)) increased significantly, exhibiting a high strength and highly formable aluminum alloy.

Figure 5:
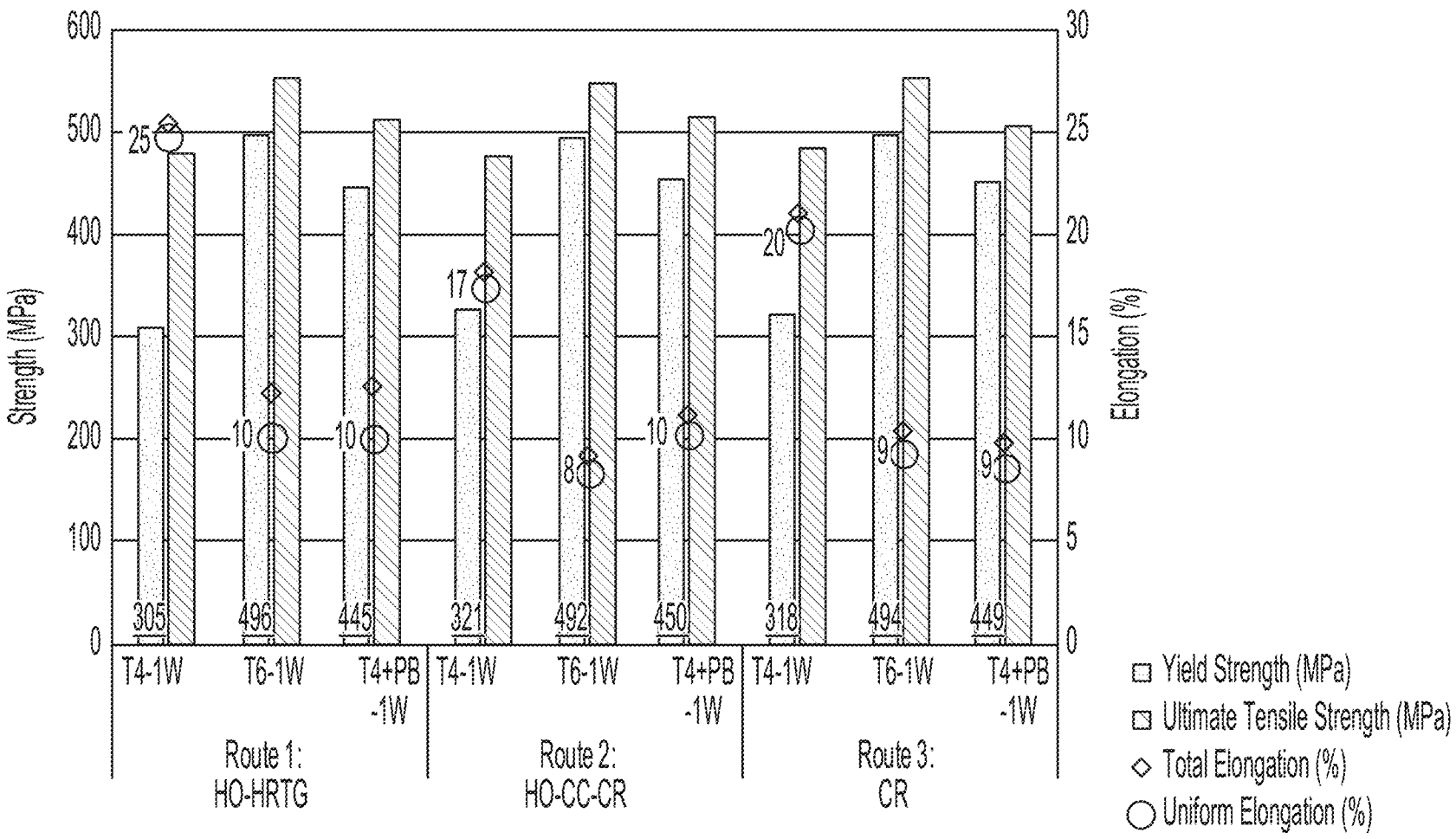
FIG. 5 is a graph showing strength and elongation properties of aluminum alloy products processed by methods described herein.

FIG. 5 is a graph showing the mechanical properties of Alloy A prepared and processed according to Route 1 (referred to as "HO-HRTG"), Route 2 (referred to as "HO-CC-CR"), and Route 3 (referred to as "CR") described herein, with pre-aging before solutionizing, and 1 week of natural aging to provide samples in a T4 temper (referred to as "T4-1W"). Additionally, artificial aging was performed by heating the samples to about 125° C. and maintaining this temperature for 24 hours to produce samples in a T6 temper (referred to as "T6-1W"). A paint baking procedure as described above was employed for certain samples (referred to as "T4+PB-1W" for the T4 samples).

Figure 6:
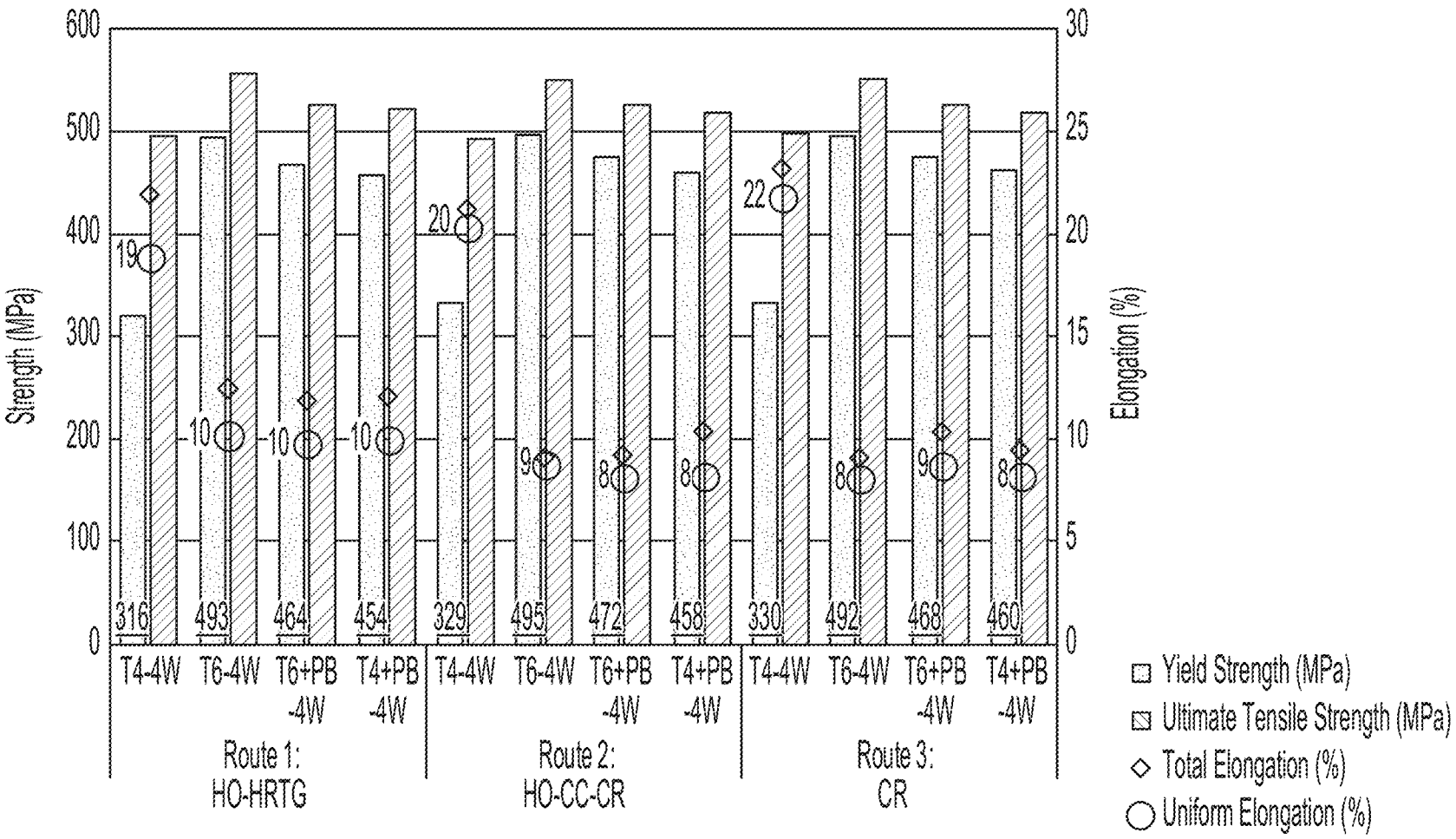
FIG. 6 is a graph showing strength and elongation properties of aluminum alloy products processed by methods described herein.

FIG. 6 is a graph showing the mechanical properties of Alloy A prepared and processed according to Route 1 (referred to as "HO-HRTG"), Route 2 (referred to as "HO-CC-CR"), and Route 3 (referred to as "CR") described herein, with pre-aging before solutionizing, and 4 weeks of natural aging to provide samples in a T4 temper (referred to as "T4-4W"). Additionally, artificial aging was performed by heating the samples to about 125° C. and maintaining this temperature for 24 hours to produce samples in a T6 temper (referred to as "T6-4W"). A paint baking procedure as described above was employed for certain samples (referred to as "T4+PB-4W" for the T4 samples and as "T6+PB-4W" for the T6 samples). As shown in FIGS. 5 and 6, pre-aging provided about a 20 MPa increase in naturally aged samples after 1 week and 1 month of natural aging, with and without the paint bake. As shown in FIG. 6, pre-aging surprisingly produced an aluminum alloy in a T4 temper having an increased formability of about 2%-3%, compared to the aluminum alloys in the example of FIG. 5, naturally aged for 1 week, regardless of the processing route.

Figure 7:
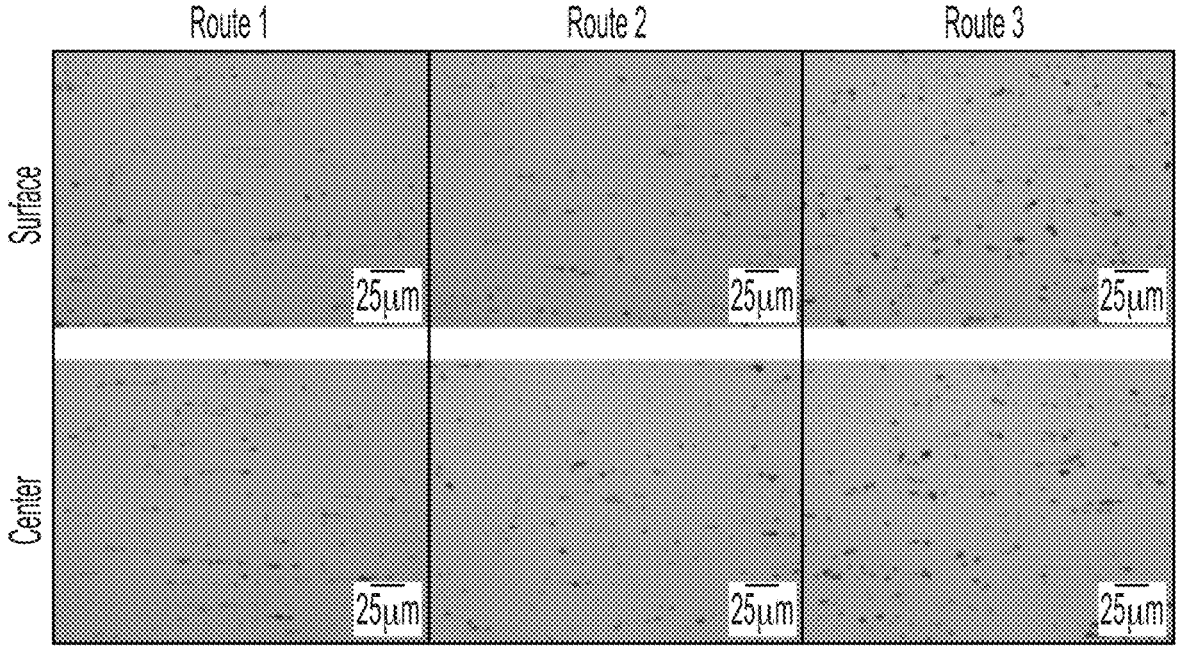
FIG. 7 contains optical microscope (OM) micrographs showing the particle distribution of undissolved intermetallic particles in an aluminum alloy product processed by methods described herein.

The microstructure of the Alloy A samples prepared and produced according to Route 1, Route 2, and Route 3 were evaluated by optical microscopy. Particle size and distribution and grain morphology were analyzed. FIG. 7 shows the particle size and distribution at the surface (top row, referred to as "Surface") and at the center (bottom row, referred to as "Center") of the aluminum alloy samples. The Alloy A sample processed via Route 3 (cold rolling without homogenization, "CR") exhibited a large distribution of undissolved particles that can lead to cracking and fracture during deformation processes (e.g., forming). The Alloy A samples processed via Routes 1 and 2 (e.g., with homogenization after initial hot rolling) exhibited a microstructure devoid of precipitates, thus allowing for improved formability.

Figure 8:
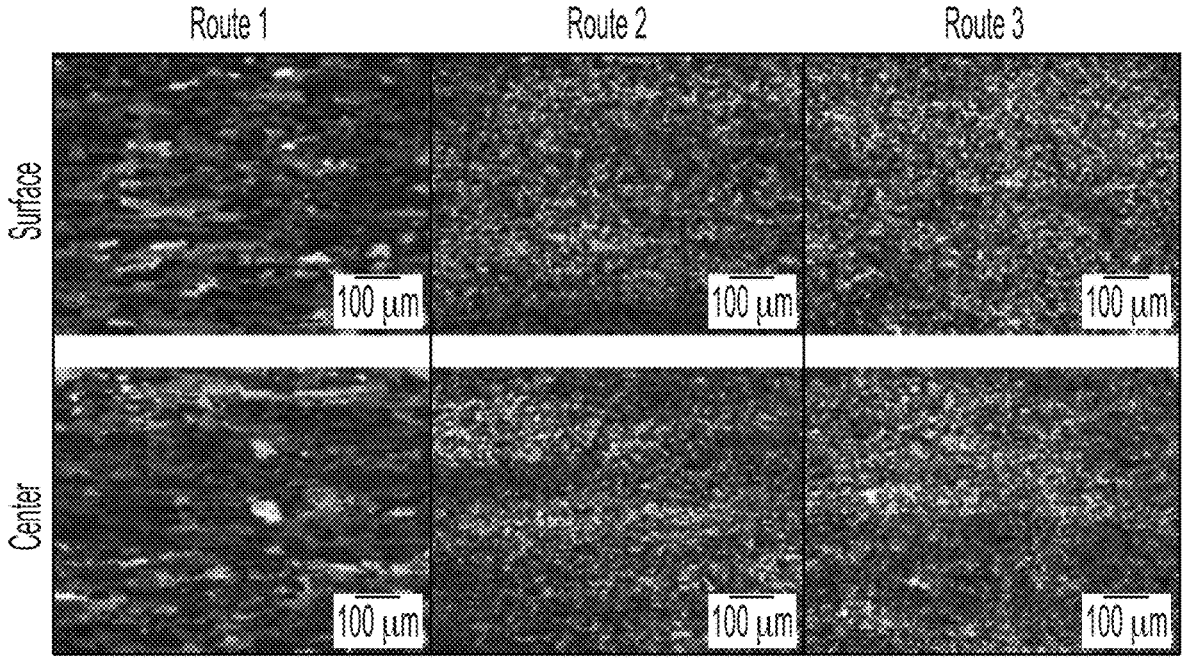
FIG. 8 contains OM micrographs showing the grain structure and undissolved intermetallic particles in an aluminum alloy product processed by methods described herein.

FIG. 8 shows the grain structure at the surface (top row, referred to as "Surface") and at the center (bottom row, referred to as "Center") of the Alloy A samples. The Alloy A sample processed via Route 3 (cold rolling without homogenization, "CR") exhibited a finer grain structure than the samples processed with homogenization. The Alloy A samples processed via Routes 1 and 2 (with homogenization after initial hot rolling) exhibited a larger grain structure, contributing to the about 20 MPa lower yield strength as in the example of FIG. 5.

Figure 9:
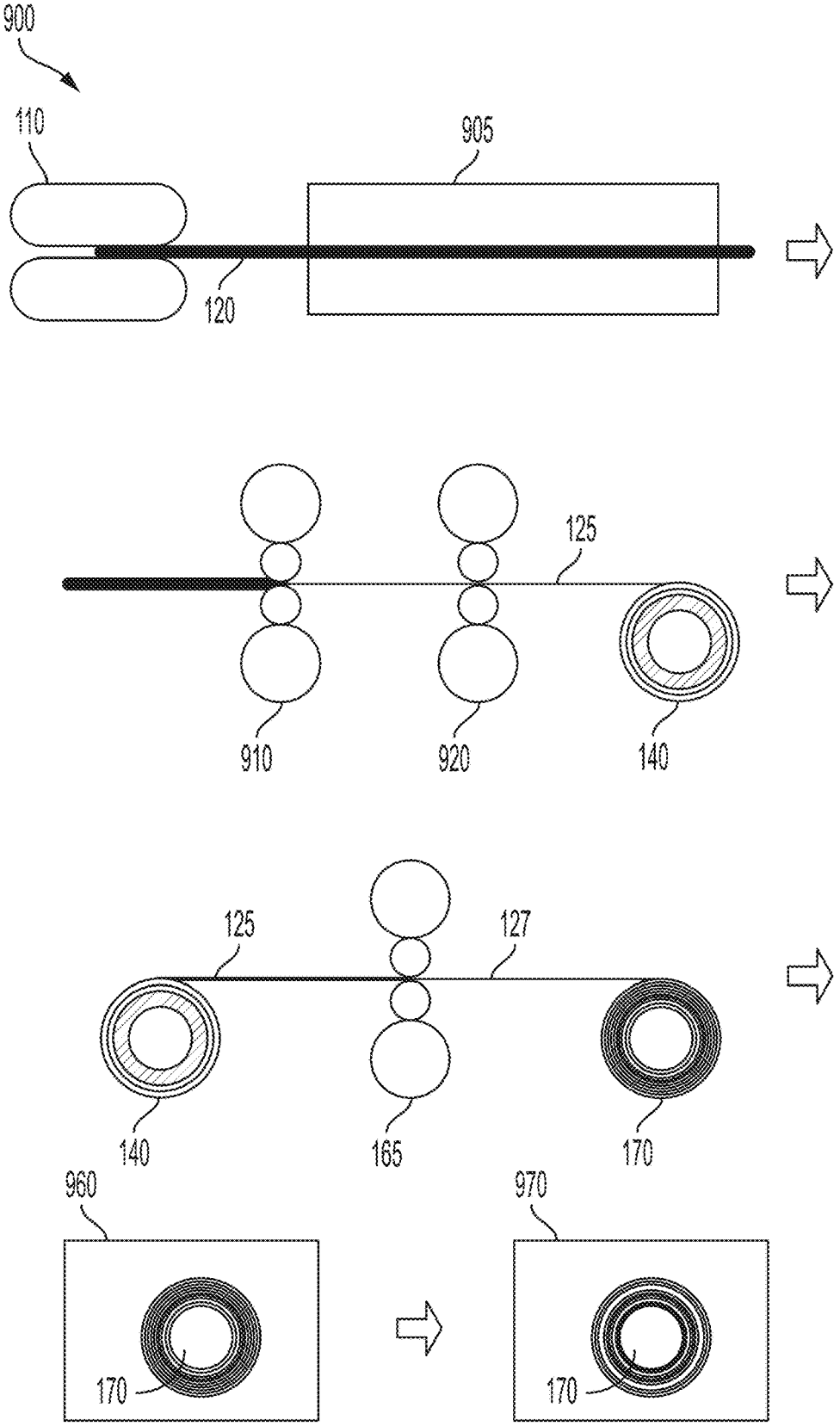
FIG. 9 is a schematic diagram depicting an aluminum alloy processing method described herein.

Example 3: Methods of Preparing, Producing, and Aging Highly Formable High Strength Aluminum Alloys An aluminum alloy processing method as described herein includes homogenizing, hot rolling, coil cooling, cold rolling to a final gauge, solutionizing, paint baking, and aging (referred to herein as "Route 4"). FIG. 9 is a schematic depicting the Route 4 processing method 900. A continuous caster 110 was employed to produce an aluminum alloy slab 120. The aluminum alloy slab 120 exited the continuous caster 110 at a temperature of from about 400° C. to about 430° C. A tunnel furnace 905 was used to homogenize the aluminum alloy slab 120 and maintain the temperature of the aluminum alloy slab 120 across a width of the aluminum alloy slab 120 at a peak metal temperature of from about 400° C. to about 520° C. for from about 1 minute to about 5 minutes. The aluminum alloy slab 120 was then processed in a first finishing mill 910 to reduce the thickness of the aluminum alloy slab 120 by about 20% to about 40% and cool the slab to about 325° C. to about 375° C. The aluminum alloy slab 120 was then processed in a second finishing mill 920 to reduce the thickness of the aluminum alloy slab 120 by about 20% to about 40% and cool the slab to about 225° C. to about 275° C. to produce a hot band 125. The hot band 125 was subsequently coiled at a temperature of less than about 250° C. and the coil 140 was then subjected to coil cooling. The coil 140 was subsequently uncoiled and the hot band 125 was further cold rolled in a cold mill 165 to produce a final gauge aluminum alloy product 127. The final gauge aluminum alloy product 127 was then coiled to provide an aluminum alloy product coil 170. The aluminum alloy product coil 170 was then subjected to solutionizing in a solutionizing furnace 960 at a temperature of about 450° C. to about 500° C. for about 2 minutes to about 5 minutes. After solutionizing, the aluminum alloy product coil 170 was quenched to about room temperature by either one of a water quench or a forced air quench. In some cases, the aluminum alloy product coil 170 was subjected to a pre-aging process before the solutionizing step. Optionally, the pre-aging process included aging at about 80° C. for about 6 hours, or the pre-aging process included aging at about 100° C. for about 2 hours. In some examples, the aluminum alloy product coil 170 was subjected to a paint baking process performed in a paint bake furnace 970 at about 160° C. to about 200° C. for about 15 minutes to about 60 minutes. In certain cases, the aluminum alloy product coil 170 was subjected to either natural aging for about 1 week to about 4 weeks. Optionally, the aluminum alloy product coil 170 was subjected to artificial aging at about 100° C. to about 140° C. for about 6 hours to about 48 hours.

Example 4: Mechanical Properties of Aged Highly Formable High Strength Aluminum Alloys Four cast aluminum alloy products were prepared as in the example of Route 4 (see Example 3) using a continuous caster, from aluminum alloy compositions shown in Table 1 below:

TABLE 1

| Alloy Compositions | | | | | | | | | |
|---|---|---|---|---|---|---|---|---|---|
| Alloy | Cu (wt. %) | Fe (wt. %) | Mg (wt. %) | Mn (wt. %) | Si (wt. %) | Ti (wt. %) | Cr (wt. %) | Zn (wt. %) | Zr (wt. %) |
| B | 0.59 | 0.18 | 3.49 | 0.09 | 0.05 | 0.01 | 0.09 | 4.50 | 0.12 |
| C | 0.18 | 0.20 | 3.27 | 0.10 | 0.08 | 0.02 | 0.01 | 4.19 | 0.11 |
| D | 0.13 | 0.27 | 2.34 | 0.29 | 0.13 | 0.015 | 0.162 | 5.05 | 0.140 |
| E | 1.60 | 0.20 | 2.61 | 0.06 | 0.08 | 0.02 | 0.20 | 5.7 | — |

Each alloy includes up to 0.15 wt. % impurities, and the remainder is aluminum.

Alloy B had a Zn/Mg ratio of about 1.29, Alloy C had a Zn/Mg ratio of about 1.28, Alloy D had a Zn/Mg ratio of about 2.16, and Alloy E had a Zn/Mg ratio of about 2.18. Additionally, Alloy E was produced using direct chill (DC) casting, and the homogenizing, hot rolling, cold rolling, solutionizing, and artificial aging described in Example 3. Samples taken from Alloy B, Alloy C, Alloy D, and Alloy E were subjected to natural aging for 1 week, natural aging for 4 weeks, or artificial aging at about 120° C. for about 24 hours. Route 4 (see Example 3) was used with and without pre-aging. In some cases, the paint baking step was performed at a temperature of about 180° C. and maintained at this temperature for about 30 minutes.

Figure 10:
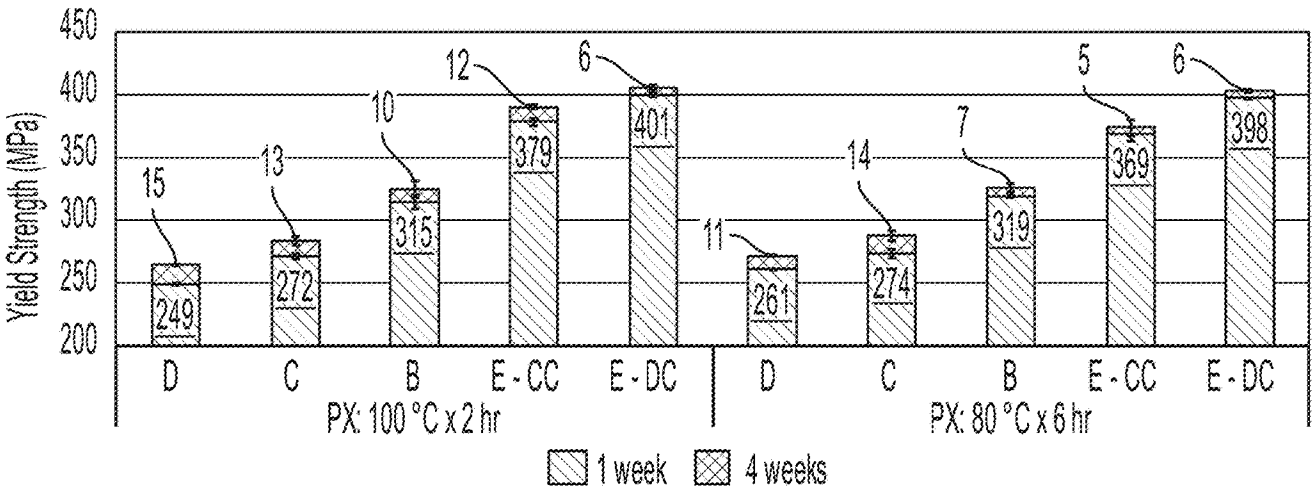
FIG. 10 is a graph showing the effects of natural aging on strength properties of aluminum alloy products processed by methods described herein.
Figure 11:
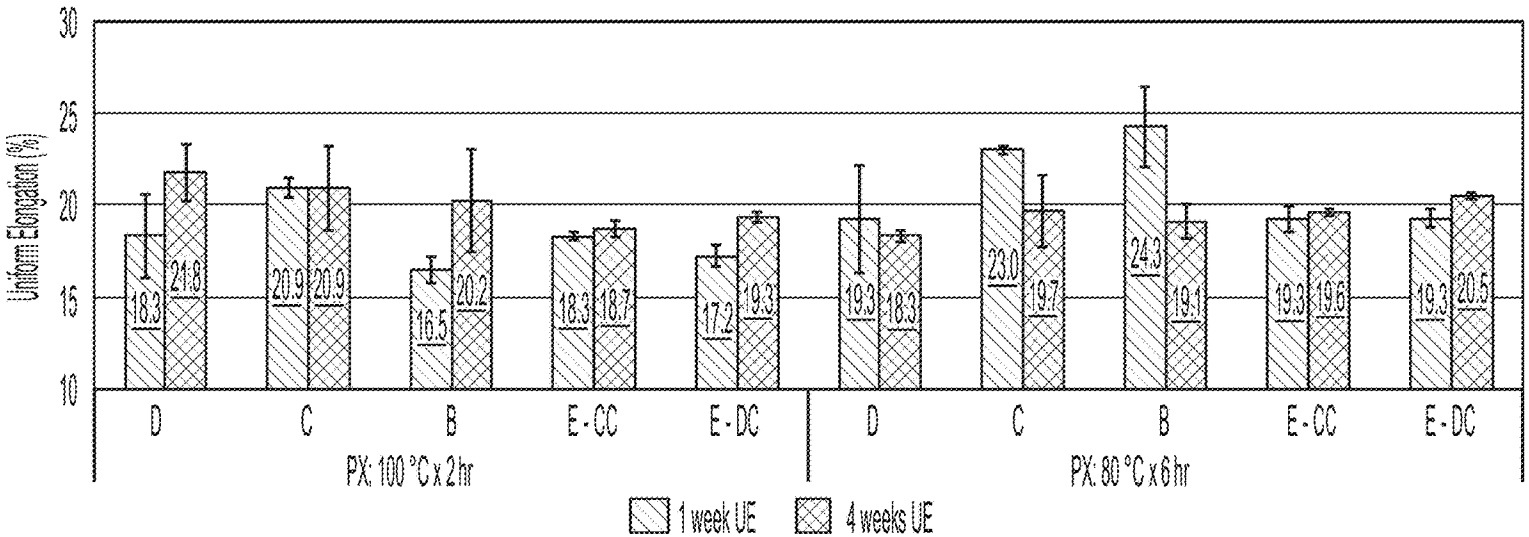
FIG. 11 is a graph showing the effects of natural aging on elongation properties of aluminum alloy products processed by methods described herein.
Figure 12:
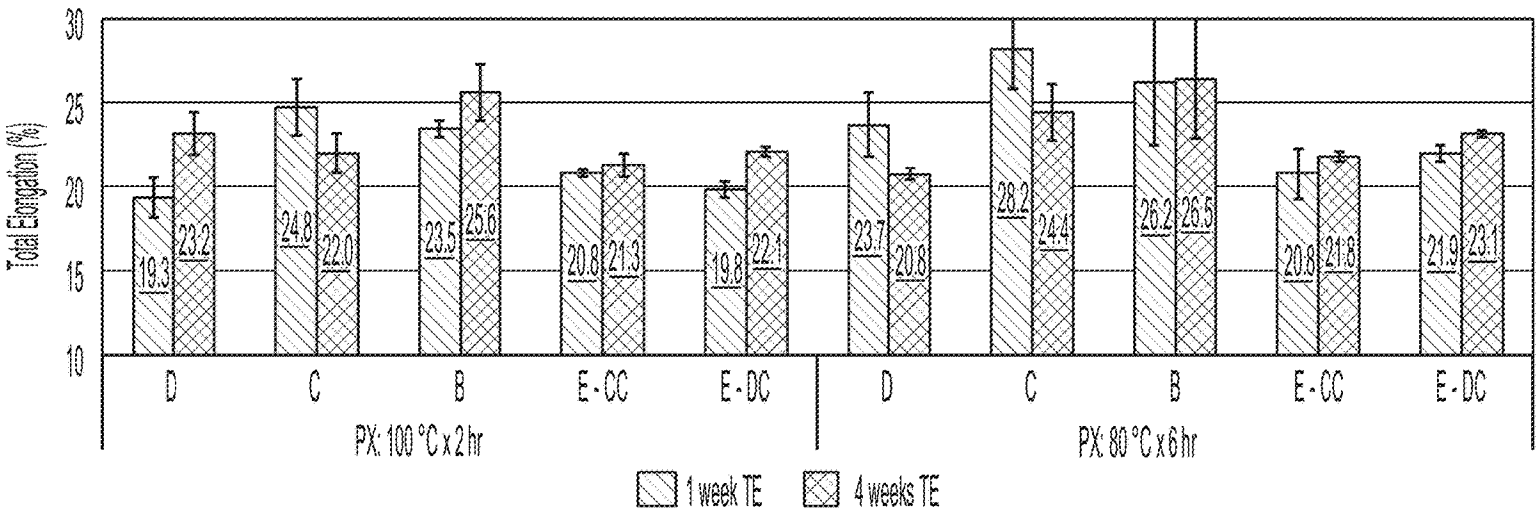
FIG. 12 is a graph showing the effects of natural aging on elongation properties of aluminum alloy products processed by methods described herein.

FIGS. 10, 11, and 12 are graphs showing the mechanical properties of Alloy B, Alloy C, Alloy D, and Alloy E prepared and processed according to methods described herein. A water quench was used to cool the alloys after solutionizing. Alloy E was prepared according to the methods described herein including continuous casting ("Alloy E-CC") and prepared including DC casting as described above ("Alloy E-DC"). After processing, all alloys were subjected to pre-aging at 100° C. for 2 hours ("PX: 100° C.×2 hr"), or pre-aging at 80° C. for 6 hours ("PX: 80° C.×6 hr") followed by 1 week of natural aging (bottom portion of each histogram) and 4 weeks of natural aging (top portion of each histogram). FIG. 10 shows the effect of natural aging on the longitudinal yield strength of the alloys. The longitudinal yield strength of each alloy was tested after 1 week of natural aging (bottom portion of each histogram), and the longitudinal yield strength of each alloy was tested after 4 weeks of natural aging (top portion of each histogram). As shown in FIG. 10, natural aging had an insignificant effect on the longitudinal yield strength of the alloys as indicated by increases in longitudinal yield strength of from about 5 MPa to about 15 MPa. Alloy E (including Alloy E-CC and Alloy E-DC) exhibited a higher longitudinal yield strength after 1 week of natural aging due to rapid aging within 24 hours of solutionizing. FIG. 11 shows the effect of natural aging on the uniform elongation of the alloys. The longitudinal uniform elongation of each alloy was tested after 1 week of natural aging (left histogram in each pair), and the uniform elongation of each alloy was tested after 4 weeks of natural aging (right histogram in each pair). As shown in FIG. 11, natural aging had an insignificant effect on the longitudinal uniform elongation of the alloys as indicated by variations in longitudinal uniform elongation of from about 0% to about 5%. FIG. 12 shows the effect of natural aging on the longitudinal total elongation of the alloys. The longitudinal total elongation of each alloy was tested after 1 week of natural aging (left histogram in each pair), and the longitudinal total elongation of each alloy was tested after 4 weeks of natural aging (right histogram in each pair). As shown in FIG. 12, natural aging had an insignificant effect on the longitudinal total elongation of the alloys as indicated by variations in longitudinal total elongation of from about 0.3% to about 4%.

Figure 13:
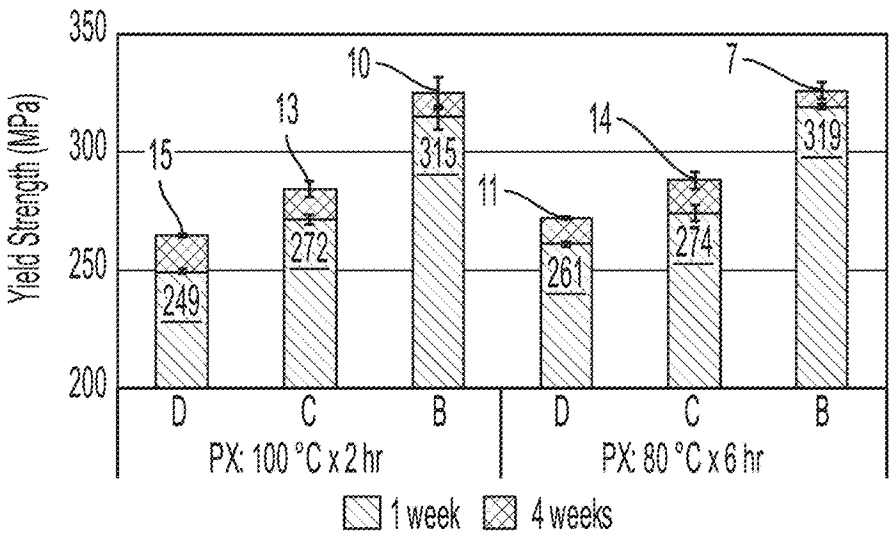
FIG. 13 is a graph showing the effects of natural aging after various quenching on strength properties of aluminum alloy products processed by methods described herein.
Figure 14:
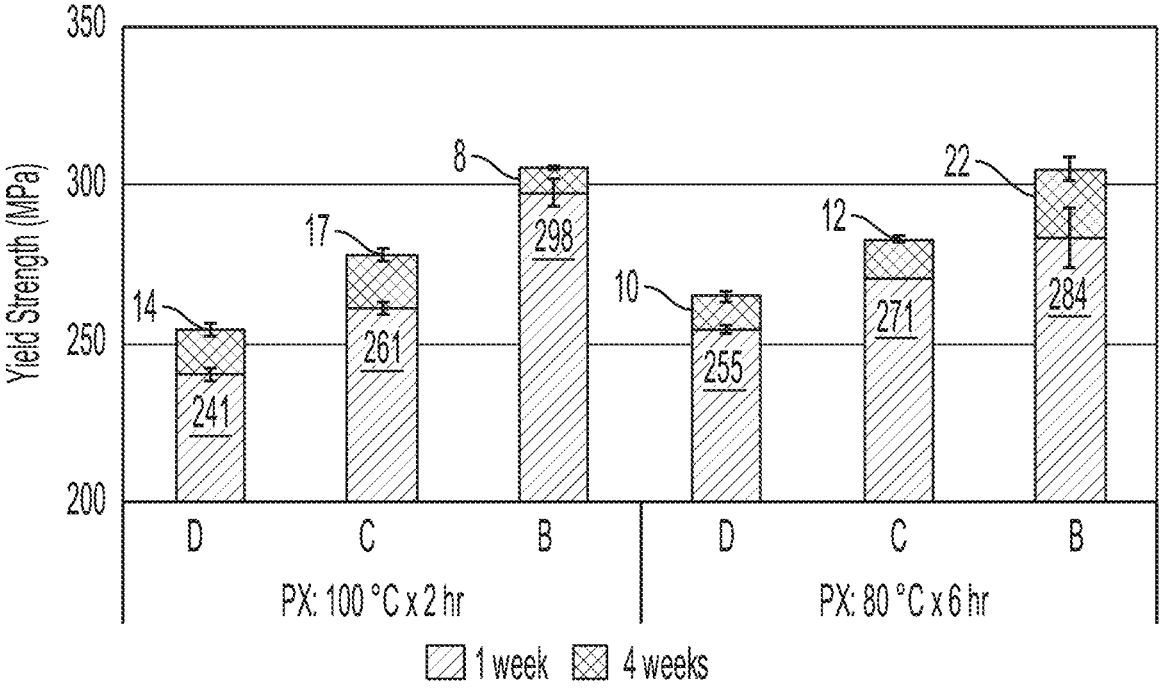
FIG. 14 is a graph showing the effects of natural aging after various quenching on strength properties of aluminum alloy products processed by methods described herein.
Figure 15:
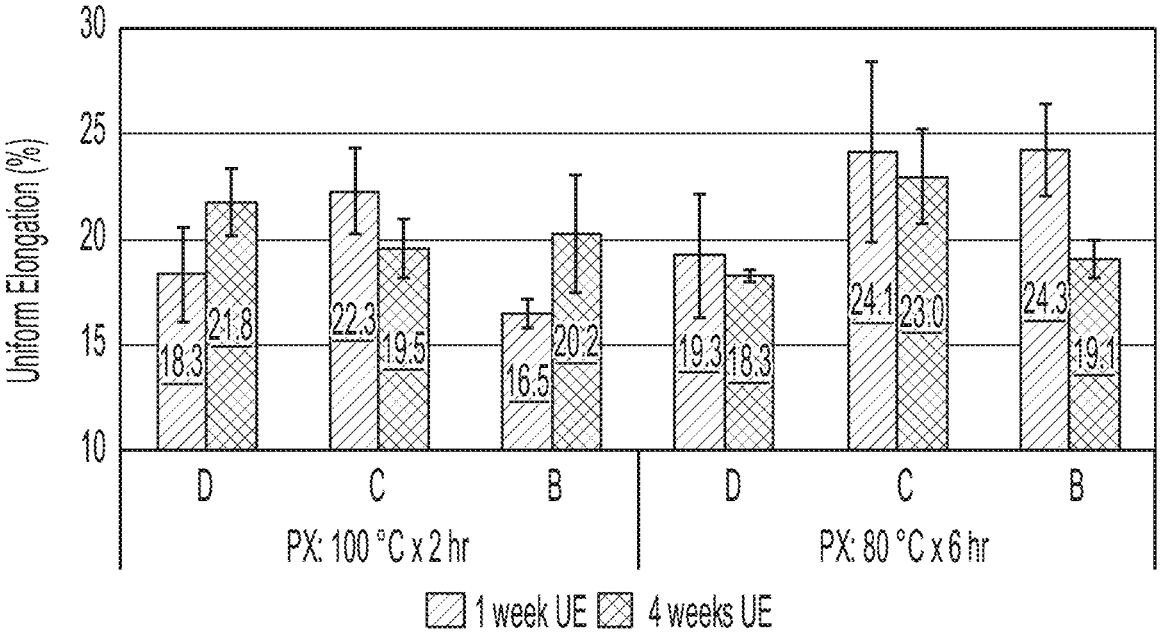
FIG. 15 is a graph showing the effects of natural aging after various quenching on elongation properties of aluminum alloy products processed by methods described herein.
Figure 16:
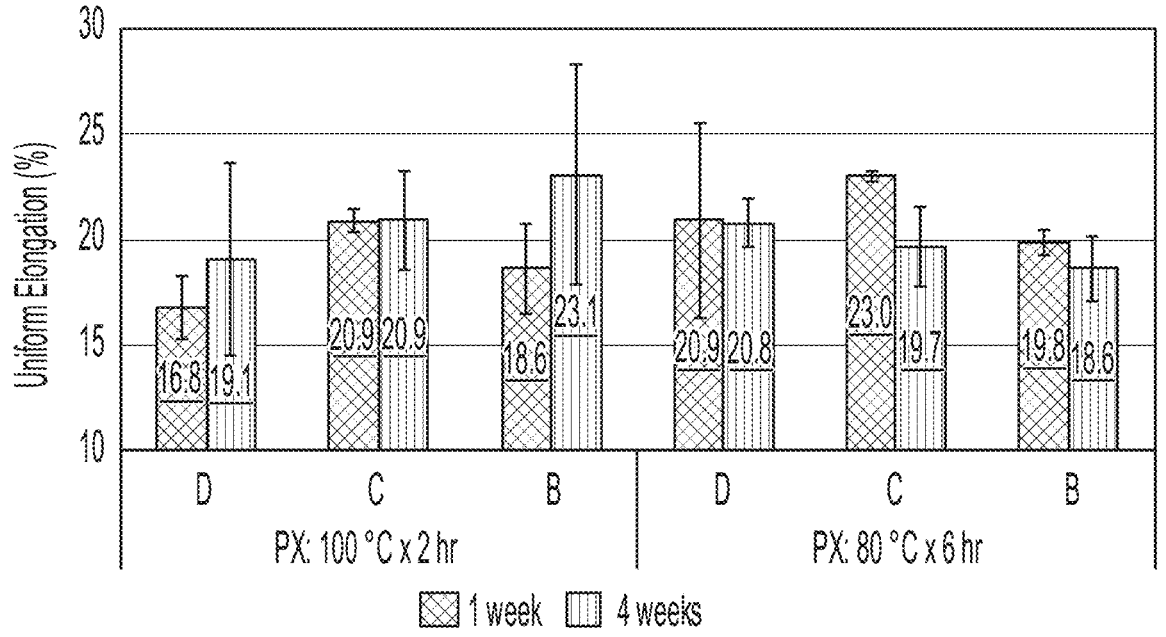
FIG. 16 is a graph showing the effects of natural aging after various quenching on elongation properties of aluminum alloy products processed by methods described herein.

FIGS. 13 and 14 are graphs showing the effects of different cooling techniques after solutionizing (e.g., the water quench and the forced air quench described above) on the mechanical properties of Alloy B, Alloy C, and Alloy D prepared and processed according to Route 4 (see Example 3). After processing, all alloys were subjected to pre-aging at 100° C. for 2 hours ("PX: 100° C.×2 hr"), or pre-aging at 80° C. for 6 hours ("PX: 80° C.×6 hr") followed by 1 week of natural aging (bottom portion of each histogram) and 4 weeks of natural aging (top portion of each histogram). FIG. 13 shows the effect of natural aging on the longitudinal yield strength of the alloy samples subjected to water quenching after solutionizing. FIG. 14 shows the effect of natural aging on the longitudinal yield strength of the alloy samples subjected to forced air quenching after solutionizing. Overall, the samples subjected to water quenching after solutionizing exhibited higher longitudinal yield strengths than the samples subjected to forced air quenching after solutionizing. However, Alloy D and Alloy C showed insignificant variations in longitudinal yield strength when comparing the cooling processes. Alloy B, having a higher solute content than Alloy C and Alloy D, showed about a 30 MPa higher strength when water quenched after solutionizing than when forced air quenched after solutionizing. Further, all alloy samples exhibited insignificant effects of natural aging on the longitudinal yield strength of the alloys. FIGS. 15 and 16 are graphs showing the effects of different cooling techniques after solutionizing (including the water quench and the forced air quench described above) on the longitudinal uniform elongation of Alloy B, Alloy C, and Alloy D prepared and processed according to Route 4 (see Example 3). After processing, all alloys were subjected to pre-aging at 100° C. for 2 hours ("PX: 100° C.×2 hr"), or pre-aging at 80° C. for 6 hours ("PX: 80° C.×6 hr") followed by 1 week of natural aging (left histogram in each pair) and 4 weeks of natural aging (right histogram in each pair). FIG. 15 shows the effect of natural aging on the longitudinal uniform elongation of the alloy samples subjected to water quenching after solutionizing. FIG. 16 shows the effect of natural aging on the longitudinal uniform elongation of the alloy samples subjected to forced air quenching after solutionizing. Overall, the samples showed insignificant variations in longitudinal uniform elongation when comparing the cooling processes. Further, all alloy samples exhibited insignificant effects of natural aging on the longitudinal uniform elongation of the alloys.

Figure 17:
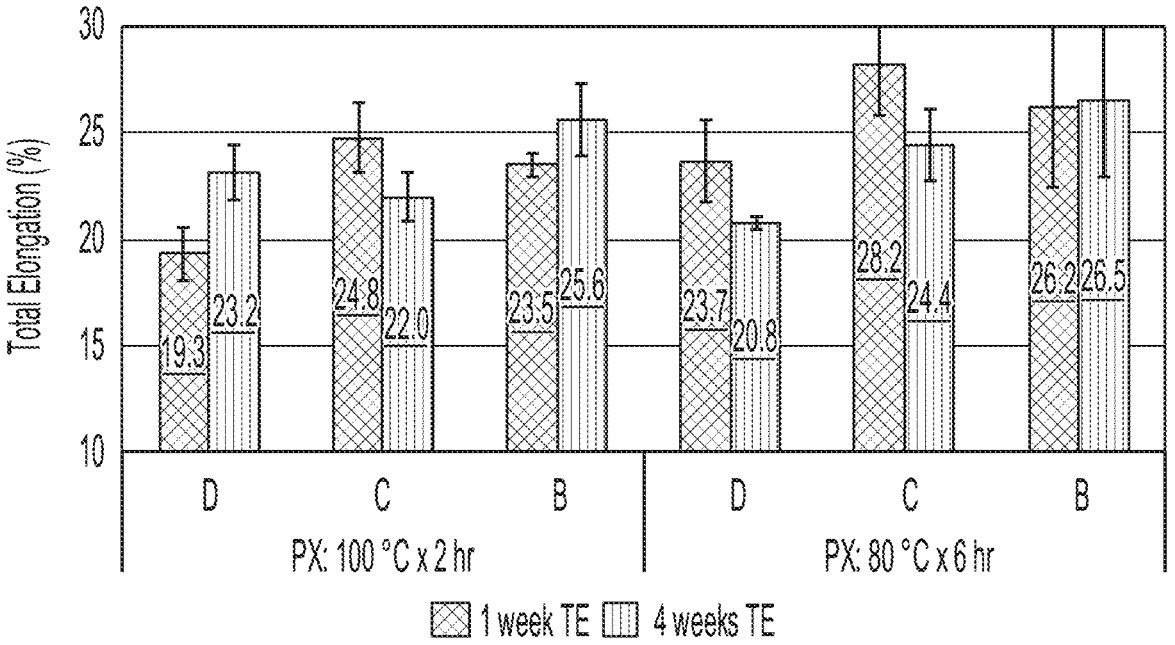
FIG. 17 is a graph showing the effects of natural aging after various quenching on elongation properties of aluminum alloy products processed by methods described herein.
Figure 18:
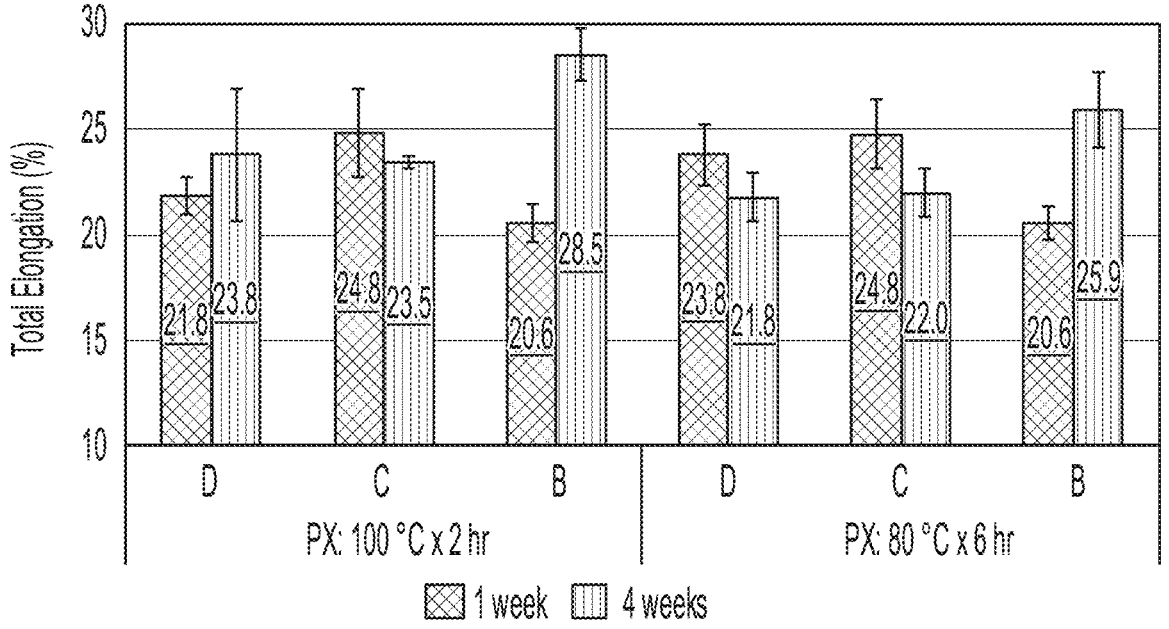
FIG. 18 is a graph showing the effects of natural aging after various quenching on elongation properties of aluminum alloy products processed by methods described herein.

FIGS. 17 and 18 are graphs showing the effects of different cooling techniques after solutionizing (including the water quench and the forced air quench described above) on the longitudinal total elongation of Alloy B, Alloy C, and Alloy D prepared and processed according to Route 4 (see Example 3). After processing, all alloys were subjected to pre-aging at 100° C. for 2 hours ("PX: 100° C.×2 hr"), or pre-aging at 80° C. for 6 hours ("PX: 80° C.×6 hr") followed by 1 week of natural aging (left histogram in each pair) and 4 weeks of natural aging (right histogram in each pair). FIG. 17 shows the effect of natural aging on the longitudinal total elongation of the alloy samples subjected to water quenching after solutionizing. FIG. 18 shows the effect of natural aging on the longitudinal total elongation of the alloy samples subjected to forced air quenching after solutionizing. Overall, the samples showed insignificant variations in longitudinal total elongation when comparing the cooling processes. Further, all alloy samples exhibited insignificant effects of natural aging on the longitudinal total elongation of the alloys.

Figure 19:
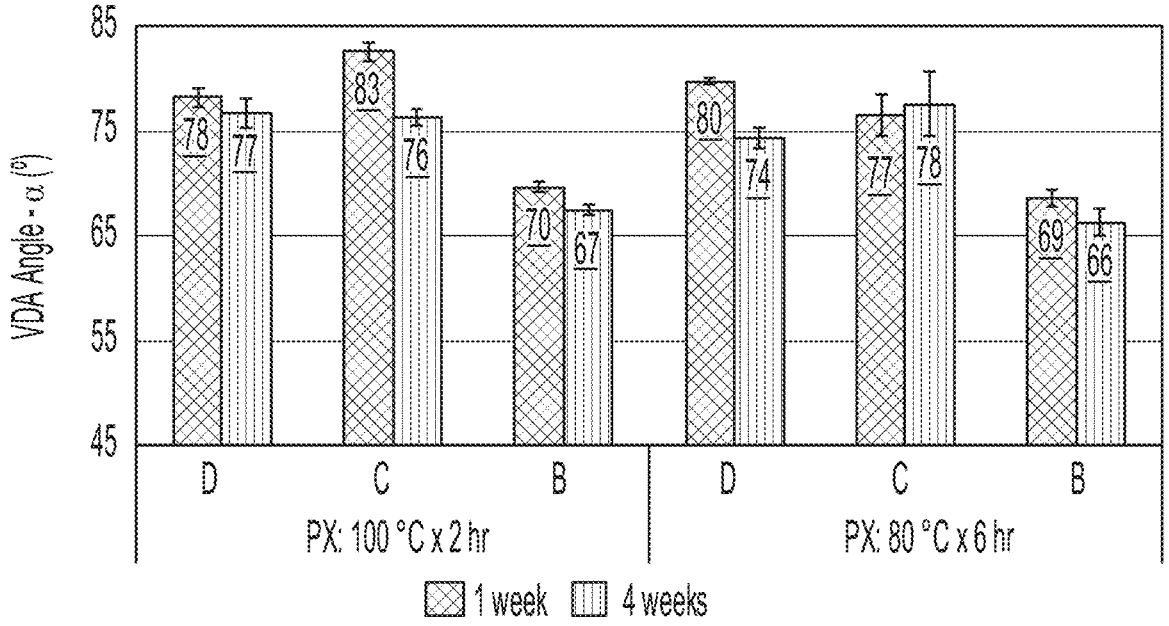
FIG. 19 is a graph showing the effects of natural aging after various quenching on bendability properties of aluminum alloy products processed by methods described herein.
Figure 20:
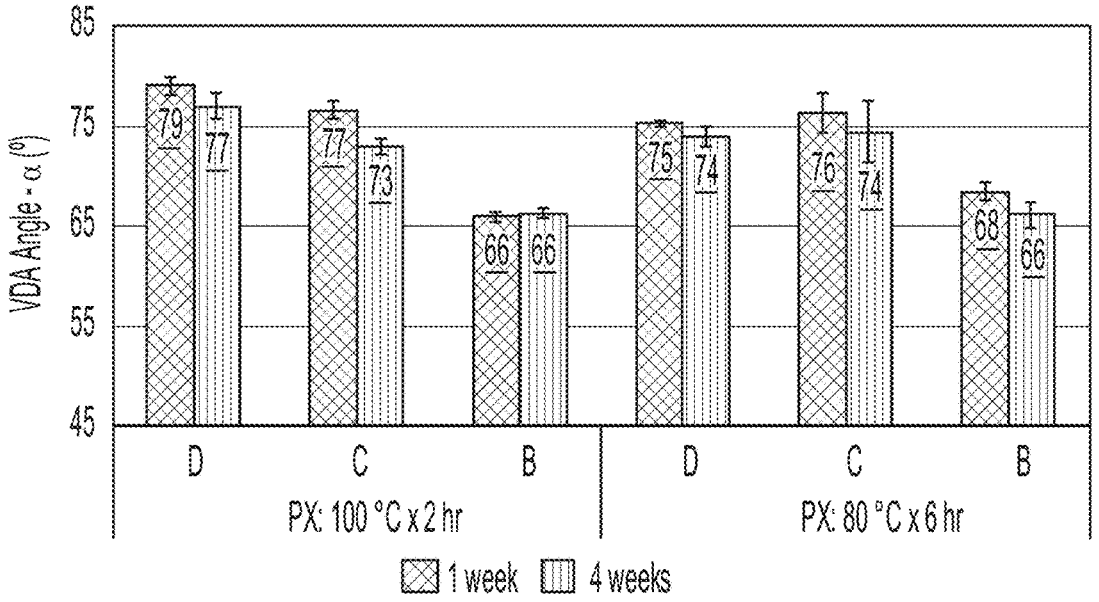
FIG. 20 is a graph showing the effects of natural aging after various quenching on bendability properties of aluminum alloy products processed by methods described herein.

FIGS. 19 and 20 are graphs showing the effects of different cooling techniques after solutionizing (including the water quench and the forced air quench described above) on the bendability (e.g., bend angle, referred to as "VDA Angle—α)(°)") of Alloy B, Alloy C, and Alloy D prepared and processed according to Route 4 (see Example 3). After processing, all alloys were subjected to pre-aging at 100° C. for 2 hours ("PX: 100° C.×2 hr"), or pre-aging at 80° C. for 6 hours ("PX: 80° C.×6 hr") followed by 1 week of natural aging (left histogram in each pair) and 4 weeks of natural aging (right histogram in each pair). FIG. 19 shows the effect of natural aging on the bendability of the alloy samples subjected to water quenching after solutionizing. FIG. 20 shows the effect of natural aging on the bendability of the alloy samples subjected to forced air quenching after solutionizing. Overall, the samples showed insignificant variations in bendability when comparing the cooling processes. Alloy B exhibited about a 10° lower bendability when compared to Alloy C and Alloy D, due to the higher solute content in Alloy B. Further, all alloy samples exhibited insignificant effects of natural aging on the bendability of the alloys.

Figure 21:
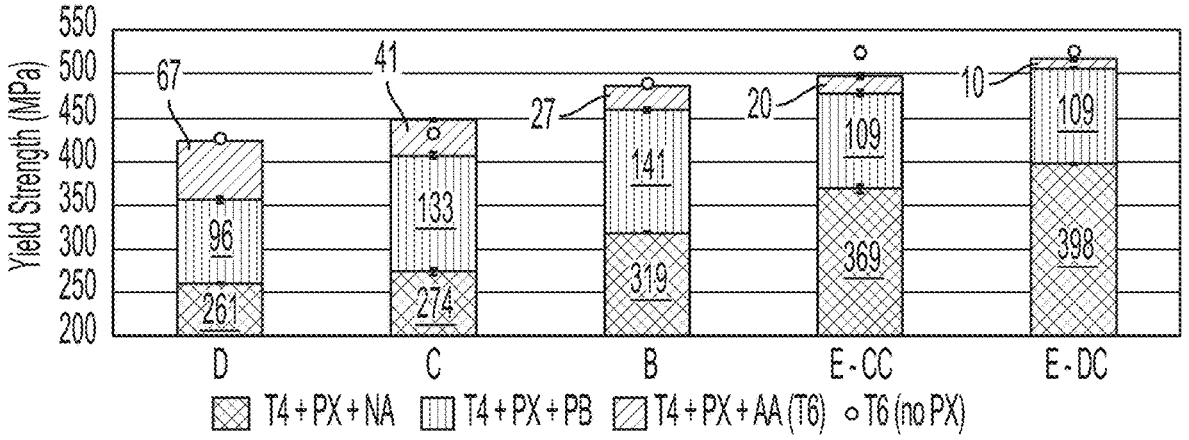
FIG. 21 is a graph showing the effects of artificial aging on strength properties of aluminum alloy products processed by methods described herein.
Figure 22:
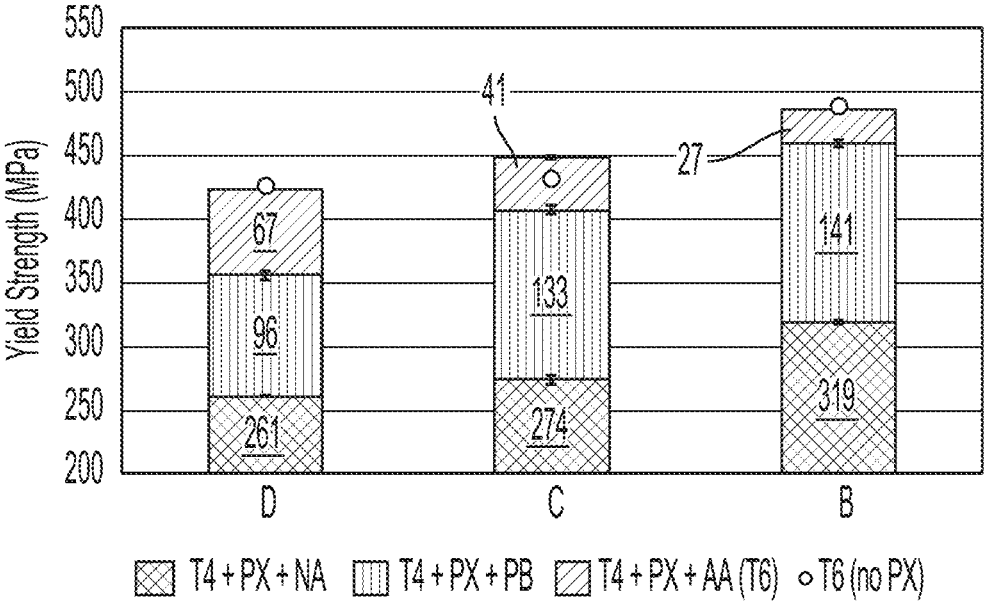
FIG. 22 is a graph showing the effects of artificial aging after various quenching on strength properties of aluminum alloy products processed by methods described herein.
Figure 23:
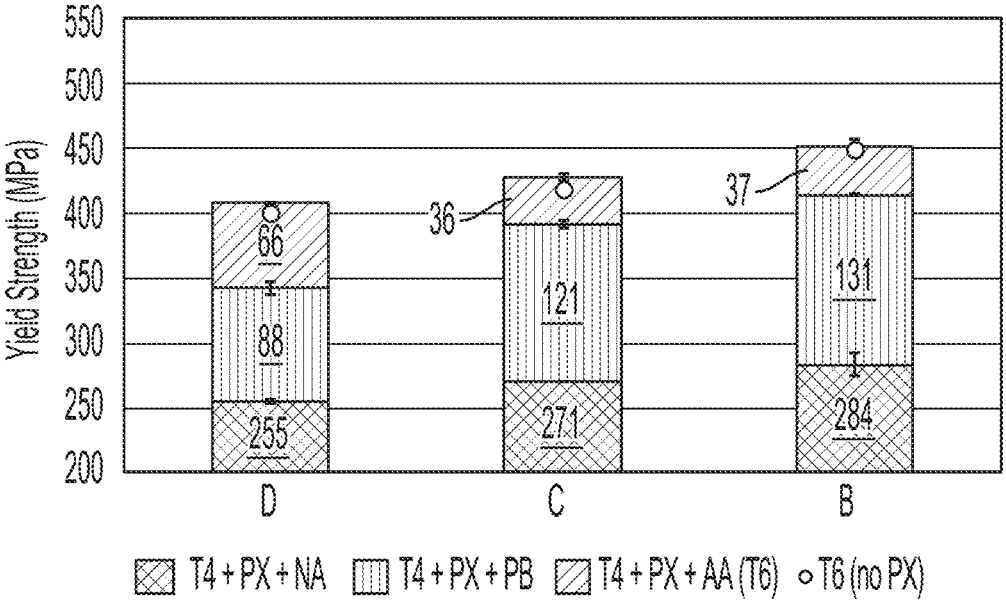
FIG. 23 is a graph showing the effects of artificial aging after various quenching on strength properties of aluminum alloy products processed by methods described herein.

FIGS. 21, 22, and 23 are graphs showing the longitudinal yield strength of Alloy B, Alloy C, Alloy D, Alloy E-CC prepared and processed according to Route 4 (see Example 3), and Alloy E-DC prepared by DC casting and processed as described above to provide the alloys in T4 temper. A water quench was used to cool the alloys after solutionizing in the examples of FIG. 21 and FIG. 22. After processing, all alloys were subjected to pre-aging at 80° C. for 6 hours ("PX"). Alloy B, Alloy D, Alloy E-CC, and Alloy E-DC) were then subjected to 4 weeks of natural aging, and Alloy C was subjected to 13 weeks of natural aging to provide the alloys in a T4 temper (bottom portion of each histogram, referred to as "T4"). Each alloy was further subjected to paint baking (middle portion of each histogram) at 180° C. for 30 minutes. Finally, each alloy was subjected to artificial aging (top portion of each histogram) at 120° C. for 24 hours. FIG. 21 shows the effect of paint baking and artificial aging on the longitudinal yield strength of the alloys. The longitudinal yield strength of each alloy was tested after each of natural aging (top portion of each histogram), paint baking (middle portion of each histogram, referred to as "PB" in FIGS. 21, 22, and 3), and artificial aging (top portion of each histogram, referred to as "AA" in FIGS. 21, 22, and 23). Additionally, each sample was provided in T6 temper without pre-aging (circles, referred to as "T6 (no PX)"). As shown in FIG. 21, paint baking (middle portion of each histogram) had varying effects on the longitudinal yield strength of each alloy after pre-aging, most notably in Alloy C and Alloy D where the paint baking increased the longitudinal yield strength by about 130 MPa to about 145 MPa after pre-aging. Artificial aging (top portion of each histogram) also had varying effects on the longitudinal yield strength of the alloys as indicated by increases in longitudinal yield strength of from about 10 MPa to about 70 MPa after pre-aging. Also shown in FIG. 21, the pre-aging and paint baking process did not adversely affect the alloys' abilities to achieve high strength in T6 temper. Thus, the alloys described herein can be provided having both high formability and high strength when processed according to the methods described herein.

FIGS. 22 and 23 are graphs showing the effects of different cooling techniques after solutionizing (including the water quench and the forced air quench described above) on the mechanical properties of Alloy B, Alloy C, and Alloy D prepared and processed according to Route 4 (see Example 3). After processing, all alloys were subjected to pre-aging at 80° C. for 6 hours ("PX"). Alloy B and Alloy D) were then subjected to 4 weeks of natural aging, and Alloy C was subjected to 13 weeks of natural aging to provide the alloys in a T4 temper (bottom portion of each histogram, referred to as "T4"). Each alloy was further subjected to paint baking (middle portion of each histogram) at 180° C. for 30 minutes. Finally, each alloy was subjected to artificial aging (top portion of each histogram) at 120° C. for 24 hours. FIG. 21 shows the effect of paint baking and artificial aging on the longitudinal yield strength of the alloys. The longitudinal yield strength of each alloy was tested after each of natural aging (bottom portion of each histogram), paint baking (in middle portion of each histogram, referred to as "PB" in FIGS. 21, 22, and 3), and artificial aging (top portion of each histogram, referred to as "AA" in FIGS. 21, 22, and 23). Additionally, each sample was provided in T6 temper without pre-aging (circles, referred to as "T6 (no PX)"). FIG. 22 shows the effect of water quenching after solutionizing on the longitudinal yield strength of the alloy samples. FIG. 23 shows the effect of forced air quenching after solutionizing on the longitudinal yield strength of the alloy samples. Overall, the samples subjected to water quenching after solutionizing exhibited higher longitudinal yield strengths than the samples subjected to forced air quenching after solutionizing. Alloy C and Alloy B showed a higher paint baking response regardless of cooling process after solutionizing.

Figure 24:
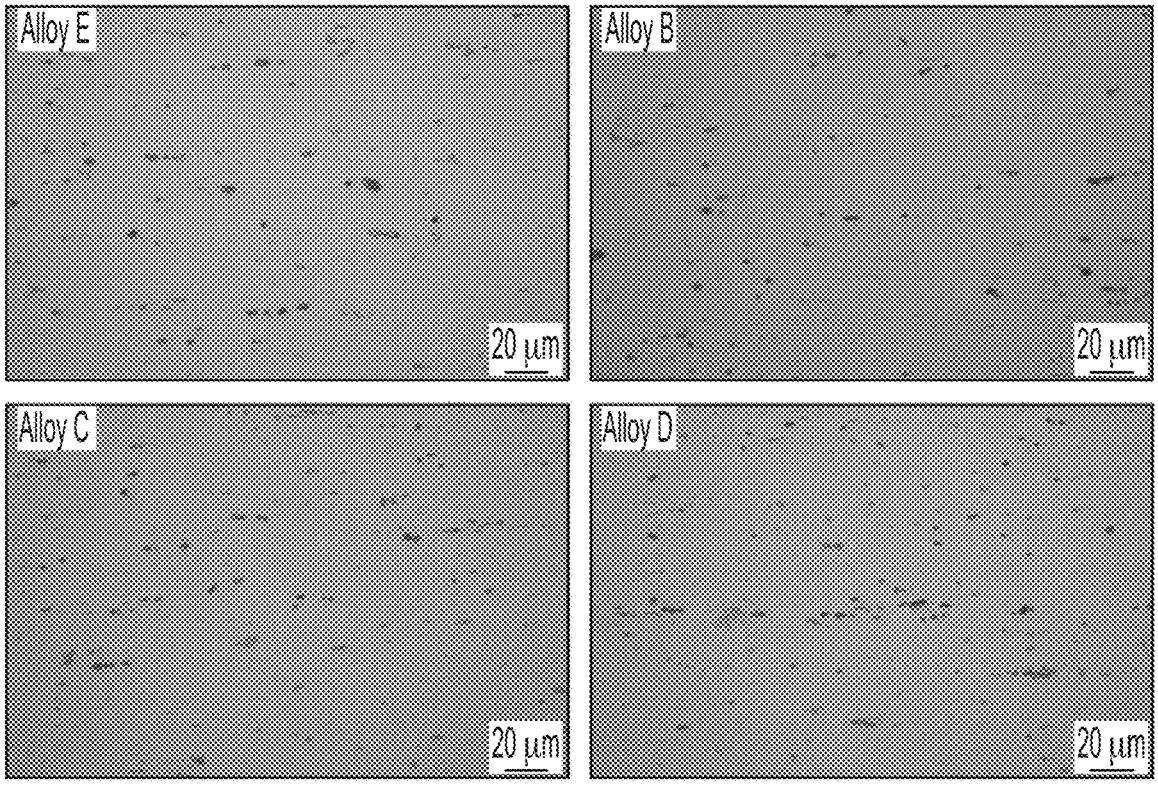
FIG. 24 contains OM micrographs showing the particle distribution of undissolved intermetallic particles in an aluminum alloy product processed by methods described herein.
Figure 25:
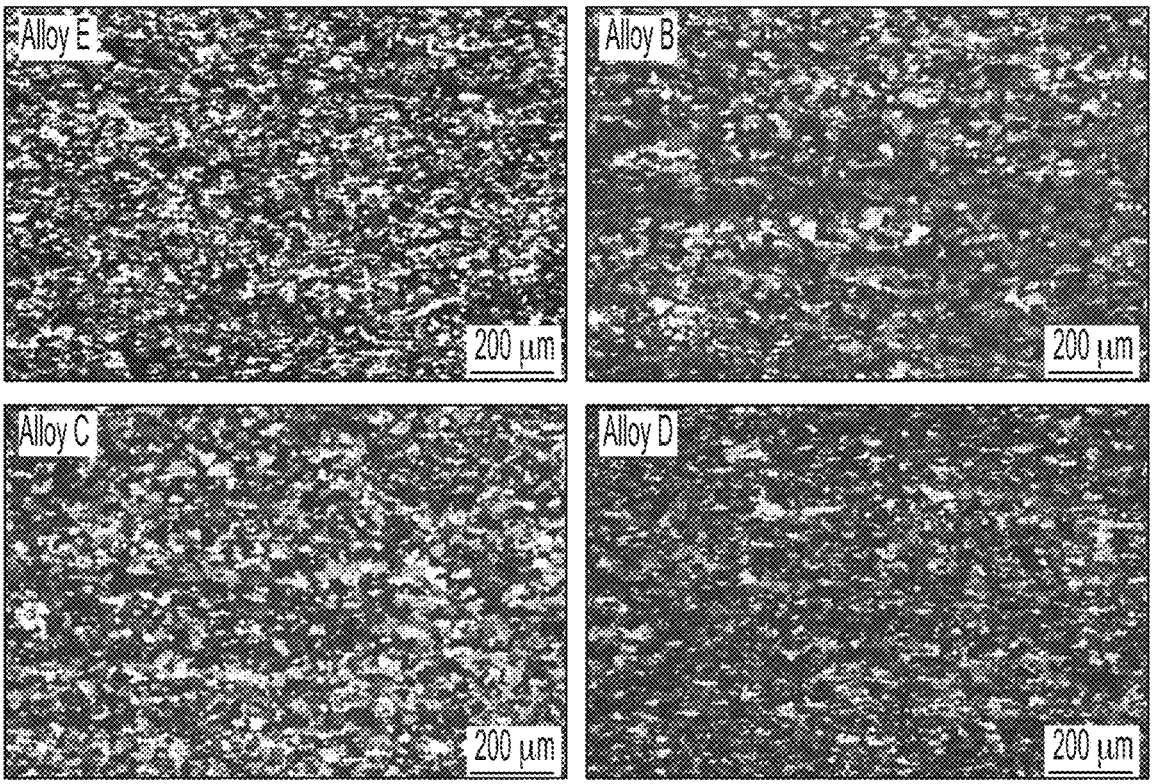
FIG. 25 contains OM micrographs showing the grain structure and undissolved intermetallic particles in an aluminum alloy product processed by methods described herein.

The microstructure of Alloy B, Alloy C, and Alloy D prepared and produced according to Route 4, and Alloy E prepared by DC casting as described above, were evaluated by optical microscopy after the solutionizing step described above. Particle size and distribution and grain morphology were analyzed. FIG. 24 shows the particle size and distribution of each alloy sample. Each alloy exhibited similar particle size and distribution and insignificant undissolved precipitate content. Dark grey particles shown in FIG. 24 are Fe-containing constituent particles. FIG. 25 shows the grain structure of each alloy sample. Each alloy sample exhibited a recrystallized microstructure. Alloy E contained smaller grains than Alloy B, Alloy C, and Alloy D.

Figure 26:
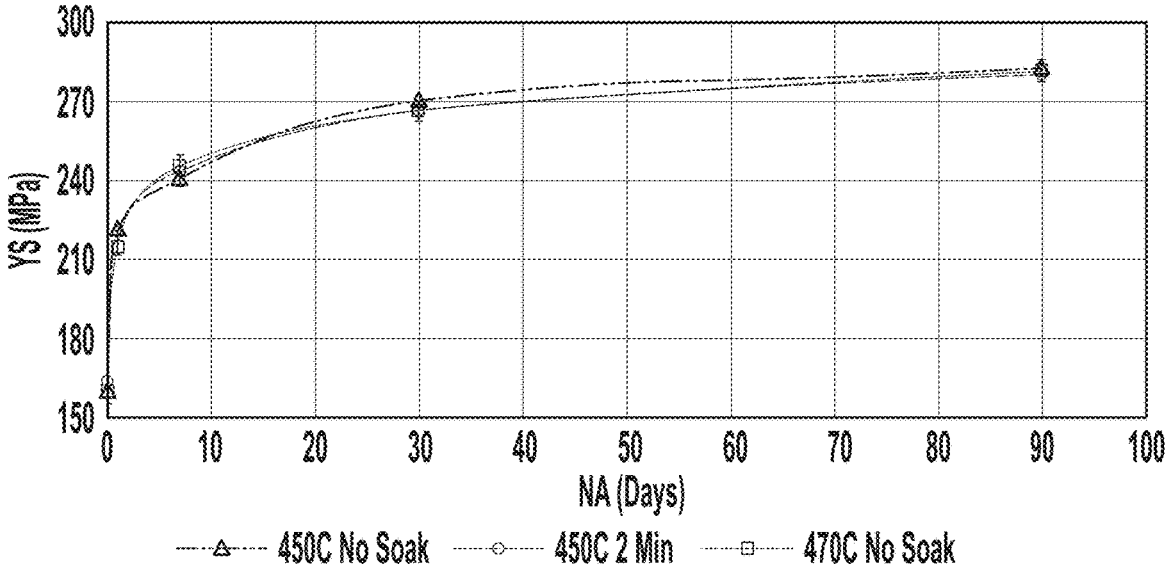
FIG. 26 is a graph showing strength properties over time of aluminum alloy products processed by methods described herein.
Figure 27:
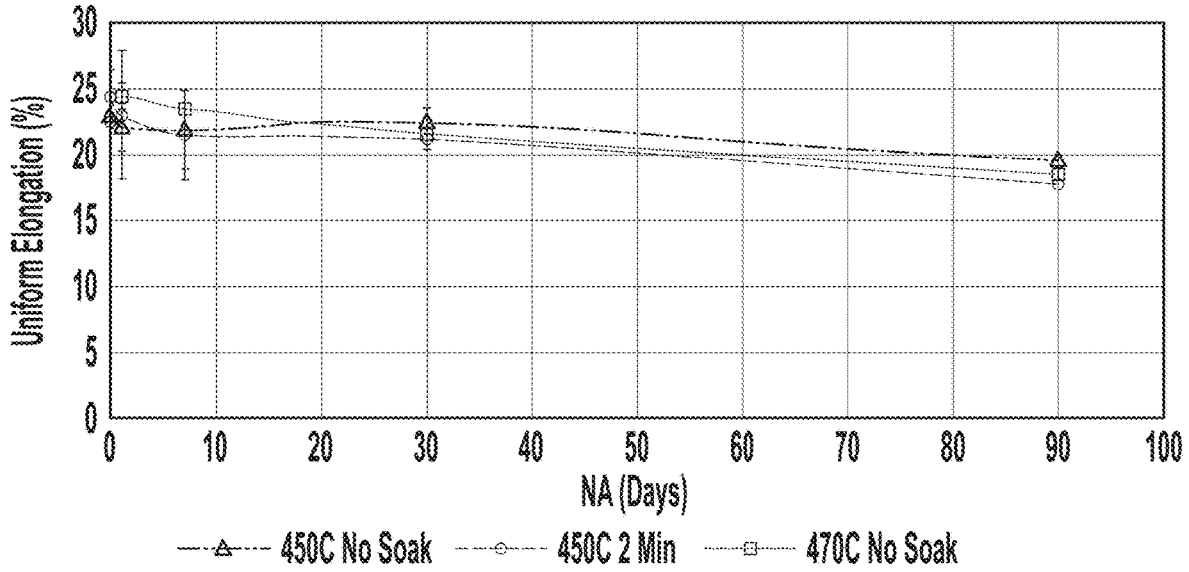
FIG. 27 is a graph showing elongation properties over time of aluminum alloy products processed by methods described herein.
Figure 28:
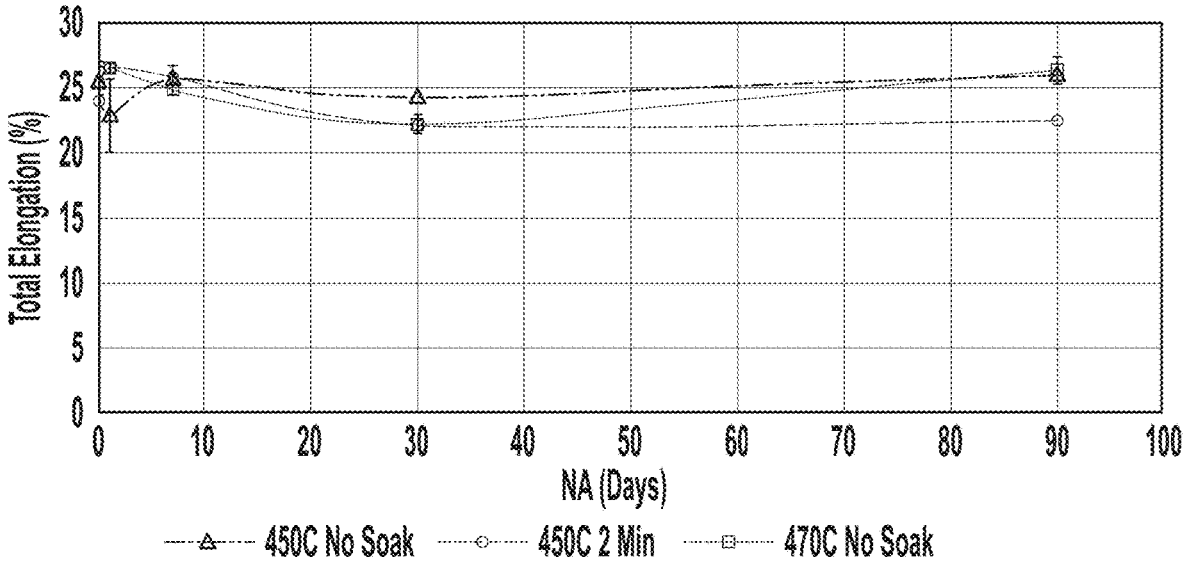
FIG. 28 is a graph showing elongation properties over time of aluminum alloy products processed by methods described herein.

FIGS. 26, 27, and 28 show the effects of various solutionizing parameters and natural aging on longitudinal yield strength, uniform elongation, and total elongation, respectively, of Alloy C produced and prepared according to Route 4 (see Example 3). Alloy C was subjected to solutionizing at a temperature of 450° C. with no soak time (lines with open triangles, referred to as "450 C No Soak" in FIGS. 26-28), solutionizing at a temperature of 450° C. with a 2 minute soak time (lines with open circles, referred to as "450 C 2 Min" in FIGS. 26-28), and solutionizing at a temperature of 470° C. with no soak time (lines with open squares, referred to as "470 C No Soak" in FIGS. 26-28). Alloy C was not subjected to pre-aging before natural aging for 90 days. As shown in FIG. 26, the yield strength exhibited a slow increase after 30 days of natural aging. As shown in FIG. 27, the uniform elongation exhibited a decrease of about 5% after 90 days of natural aging. As shown in FIG. 28, the total elongation showed insignificant change after 90 days of natural aging.

Thus, the alloy compositions described herein, combined with the processing methods described herein, provide highly formable and high strength aluminum alloys.

All patents, publications and abstracts cited above are incorporated herein by reference in their entireties. Various embodiments of the invention have been described in fulfillment of the various objectives of the invention. It should be recognized that these embodiments are merely illustrative of the principles of the present invention. Numerous modifications and adaptions thereof will be readily apparent to those skilled in the art without departing from the spirit and scope of the present invention as defined in the following claims.

What is claimed is:

1. A method of producing a formable high strength aluminum alloy product, comprising:

continuously casting a molten aluminum alloy composition to provide a cast aluminum alloy product having a casting exit temperature, wherein the molten aluminum alloy composition comprises an aluminum alloy comprising at least 0.1 wt. % Zr, at least 2 wt. % Mg, and Zn as the element with the highest content in the composition other than Al;

hot rolling the cast aluminum alloy product to provide an aluminum alloy hot band;

coiling the aluminum alloy hot band to provide a hot band coil;

cooling the hot band coil to a temperature of from 200° C. to 400° C.;

maintaining the hot band coil at the temperature of from 200° C. to 400° C. for 1 hour or more;

further processing the hot band coil to provide a final gauge aluminum alloy product; and solutionizing the final gauge aluminum alloy product.

2. The method of claim 1, wherein the molten aluminum alloy composition comprises a Zn to Mg ratio of from 1.2 to 3.

3. The method of claim 1, wherein the hot rolling comprises heating the cast aluminum alloy product to a hot rolling entry temperature.

4. The method of claim 1, wherein the hot rolling is performed to reduce a thickness of the cast aluminum alloy product by at least 30%.

5. The method of claim 1, wherein the further processing comprises:

homogenizing the hot band coil to provide a homogenized hot band coil; and hot rolling the homogenized hot band coil to provide the final gauge aluminum alloy product.

6. The method of claim 1, wherein the further processing comprises:

homogenizing the hot band coil to provide a homogenized hot band coil;

cooling the homogenized hot band coil; and cold rolling the homogenized hot band coil to provide a final gauge aluminum alloy product.

7. The method of claim 6, wherein the homogenizing comprises heating the aluminum alloy hot band to a temperature of at least 450° C. and maintaining the aluminum alloy hot band at the temperature of at least 450° C. for a time period of at least 90 minutes.

8. The method of claim 1, wherein the further processing comprises:

cold rolling the hot band coil to provide a final gauge aluminum alloy product.

9. The method of claim 1, further comprising pre-aging the final gauge aluminum alloy product, wherein the pre-aging comprises heating the final gauge aluminum alloy product to a pre-aging temperature of from 50° C. to 150° C. and maintaining the pre-aging temperature for a period of from 1 hour to 24 hours.

10. The method of claim 1, further comprising aging the final gauge aluminum alloy product to achieve a yield strength of at least 400 MPa.

11. The method of claim 10, wherein the aging comprises one or more of natural aging, artificial aging, paint baking, and post-forming heat treating.

12. The method of claim 11, wherein the aging comprises natural aging and the natural aging comprises maintaining the final gauge aluminum alloy product at room temperature for a period of from 1 day to 12 weeks.

13. The method of claim 11, wherein the aging comprises artificial aging and the artificial aging comprises heating the final gauge aluminum alloy product to an artificial aging temperature of from 100° C. to 250° C. and maintaining the artificial aging temperature for a period of from 1 hour to 72 hours.

14. The method of claim 11, wherein the aging comprises paint baking and the paint baking comprises heating the final gauge aluminum alloy product to a paint baking temperature of from 75° C. to 250° C. and maintaining the paint baking temperature for a period of from 15 minutes to 3 hours.

15. The method of claim 11, wherein the aging comprises post-forming heat treating and the post-forming heat treating comprises heating the final gauge aluminum alloy product to a post-forming heat treating temperature of from 100° C. to 250° C. and maintaining the post-forming heat treating temperature for a period of from 1 hour to 24 hours.

* * * * *